US009051643B2

(12) United States Patent
Middeke et al.

(10) Patent No.: US 9,051,643 B2
(45) Date of Patent: Jun. 9, 2015

(54) PROCESS FOR METALLIZING NONCONDUCTIVE PLASTIC SURFACES

(71) Applicant: Atotech Deutschland GmbH, Berlin (DE)

(72) Inventors: Hermann Middeke, Falkensee (DE); Enrico Kuhmeiser, Berlin (DE); Steve Schneider, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 14/379,497

(22) PCT Filed: Mar. 15, 2013

(86) PCT No.: PCT/EP2013/055357

§ 371 (c)(1),
(2) Date: Aug. 19, 2014

(87) PCT Pub. No.: WO2013/135863

PCT Pub. Date: Sep. 19, 2013

(65) Prior Publication Data

US 2015/0017331 A1 Jan. 15, 2015

(30) Foreign Application Priority Data

Mar. 15, 2012 (EP) ..... 12159659

(51) Int. Cl.

| | |
|---|---|
| ***C23C 18/24*** | (2006.01) |
| ***C23C 18/22*** | (2006.01) |
| ***C25D 5/56*** | (2006.01) |
| ***C23C 18/28*** | (2006.01) |
| *C23C 18/16* | (2006.01) |
| *C23C 18/30* | (2006.01) |
| *C23C 18/20* | (2006.01) |

(52) U.S. Cl.

CPC ..... *C23C 18/24* (2013.01); *C23C 18/22* (2013.01); *C25D 5/56* (2013.01); *C23C 18/1653* (2013.01); *C23C 18/30* (2013.01); *C23C 18/2073* (2013.01); *C23C 18/1641* (2013.01); *C23C 18/166* (2013.01); *C23C 18/2086* (2013.01); *C23C 18/28* (2013.01)

(58) Field of Classification Search

CPC ..... C23C 18/24
USPC ..... 427/304
See application file for complete search history.

(56) References Cited

U.S. PATENT DOCUMENTS 2,847,273 A * 8/1958 Katzin ..... 423/253
3,652,351 A * 3/1972 Guisti ..... 216/83

(Continued)

FOREIGN PATENT DOCUMENTS

EP 0616049 9/1994

OTHER PUBLICATIONS

PCT/EP2013/055357; PCT International Search Report and Written Opinion of the International Searching Authority dated Jul. 10, 2013.

(Continued)

*Primary Examiner* — Nathan T Leong
(74) *Attorney, Agent, or Firm* — Renner, Otto, Boisselle & Sklar, LLP

(57) ABSTRACT

The present invention relates to a process for metallizing nonconductive plastics using etching solutions free of hexavalent chromium. The etching solutions are based on permanganate solutions. After the treatment of the plastics with the etching solutions, the plastics are metallized by means of known processes.

20 Claims, 4 Drawing Sheets

(56) References Cited

U.S. PATENT DOCUMENTS

| | | | | |
|---|---|---|---|---|
| 4,629,636 | A * | 12/1986 | Courduvelis et al. | 427/444 |
| 5,286,530 | A | 2/1994 | Karas et al. | |
| 2010/0012500 | A1 * | 1/2010 | Lachowicz et al. | 205/183 |

OTHER PUBLICATIONS

PCT/EP2013/055357; PCT International Preliminary Report on Patentability mailed Sep. 25, 2014.

* cited by examiner

PROCESS FOR METALLIZING NONCONDUCTIVE PLASTIC SURFACES

The present application is a U.S. National Stage Application based on and claiming benefit and priority under 35 U.S.C. §371 of International Application No. PCT/EP2013/055357, filed 15 Mar. 2013, which in turn claims benefit of and priority to European Application No. 12159659.7 filed 15 Mar. 2012, the entirety of each of which is hereby incorporated herein by reference.

FIELD OF THE INVENTION

The present invention relates to a process for metallizing electrically nonconductive plastic surfaces of articles using etching solutions free of hexavalent chromium. The etching solutions are based on permanganate solutions. After the treatment with the etching solutions, the articles can be metallized by means of known processes.

BACKGROUND OF THE INVENTION

Articles made from electrically nonconductive plastic can be metallized by an electroless metallization process or alternatively by a direct electroplating process. In both processes, the article is first cleaned and etched, then treated with a noble metal and finally metallized. The etching is typically undertaken by means of chromosulphuric acid. The etching serves to make the surface of the article receptive to the subsequent metallization, such that the surfaces of the articles are well-wetted with the respective solutions in the subsequent treatment steps and the deposited metal ultimately has sufficiently firm adhesion on the surface.

For etching, the surface of articles, for example made from acrylonitrile-butadiene-styrene copolymer (ABS copolymer), is etched using chromosulphuric acid, so as to form surface microcaverns in which metal is deposited and subsequently adheres there firmly. After the etching, the plastic is activated for the electroless metallization by means of an activator comprising a noble metal, and then metallized electrolessly. Subsequently, a thicker metal layer can also be applied electrolytically. In the case of the direct electroplating process, which does not need an electroless metallization, the etched surface is typically treated with a palladium colloid solution. Subsequently, the surface is contacted with an alkaline solution comprising copper ions complexed with a complexing agent to increase the conductivity. This step leads to the formation of a copper layer and hence to a metal layer on the surface of the article with elevated conductivity. Thereafter, the article can be directly electrolytically metallized (EP 1 054 081 B1). Etching solutions based on chromosulphuric acid, however, are toxic and should therefore be replaced as possible.

The literature describes attempts to replace etching solutions based on chromosulphuric acid with those comprising permanganate salts. The use of permanganates in an alkaline medium for metallization of circuit boards as a carrier of electronic circuits has long been established. Since the hexavalent state (manganate) which arises in the oxidation is water-soluble and has sufficient stability under alkaline conditions, the manganate, similarly to trivalent chromium, can be oxidized electrolytically back to the original oxidizing agent, in this case the permanganate. The document DE 196 11 137 A1 describes the use of the permanganate also for metallization of other plastics as circuit board material. For the metallization of ABS plastics, a solution of alkaline permanganate has been found to be unsuitable since it was not possible in this way to obtain a reliable, sufficient adhesion strength between metal layer and plastic substrate. This adhesion strength is determined in the "peel test". It should have at least a value of 0.4 N/mm.

EP 1 0010 52 discloses an acidic permanganate solution which is said to be suitable for use in plastic electroplating. The solutions described therein differ in several respects from the present invention, for example because they use very high acid concentrations and very low permanganate concentrations (e.g. 15 M $H_2SO_4$ and 0.05 M $KMnO_4$). EP 1 0010 52 does not report the adhesion strengths achievable by this etching treatment. In-house experiments have shown that the adhesion strengths are below a value of 0.4 N/mm. Moreover, the solutions described in EP 1 0010 52 are unstable. A constant quality of the metallization therefore cannot be achieved.

As an alternative to chromosulphuric acid, WO 2009/023628 A2 proposes strongly acidic solutions comprising an alkali metal permanganate salt. The solution contains about 20 g/l alkali metal permanganate salt in 40-85% by weight phosphoric acid. Such solutions form colloidal manganese (IV) species which are difficult to remove. According to WO 2009/023628 A2, the effect of the colloids even after a short time is that coating of adequate quality is no longer possible. To solve the problem, WO 2009/023628 A2 proposes using manganese(VII) sources which do not contain any alkali metal or alkaline earth metal ions. However, the preparation of such manganese(VII) sources is costly and inconvenient. Toxic chromosulphuric acid is therefore still being used for etching treatment of plastics.

In the conventional electroplating of plastic substrates, in which a first metal layer is first deposited without external current, sometimes less than 1 mg/m$^2$ of palladium on the plastic surface is sufficient to start the metal deposition without external current. In direct electroplating, which does not need electroless metallization, at least 30 mg/m$^2$ to 50 mg/m$^2$ of palladium on the plastic surface is required to enable electrolytic metallization. 40 mg/m$^2$ of palladium is generally sufficient for direct electroplating. These minimum amounts of palladium on plastic surfaces have to date been achievable only when the plastic surfaces have been etched with toxic chromosulphuric acid prior to metallization.

DESCRIPTION OF THE INVENTION

Figure 1:
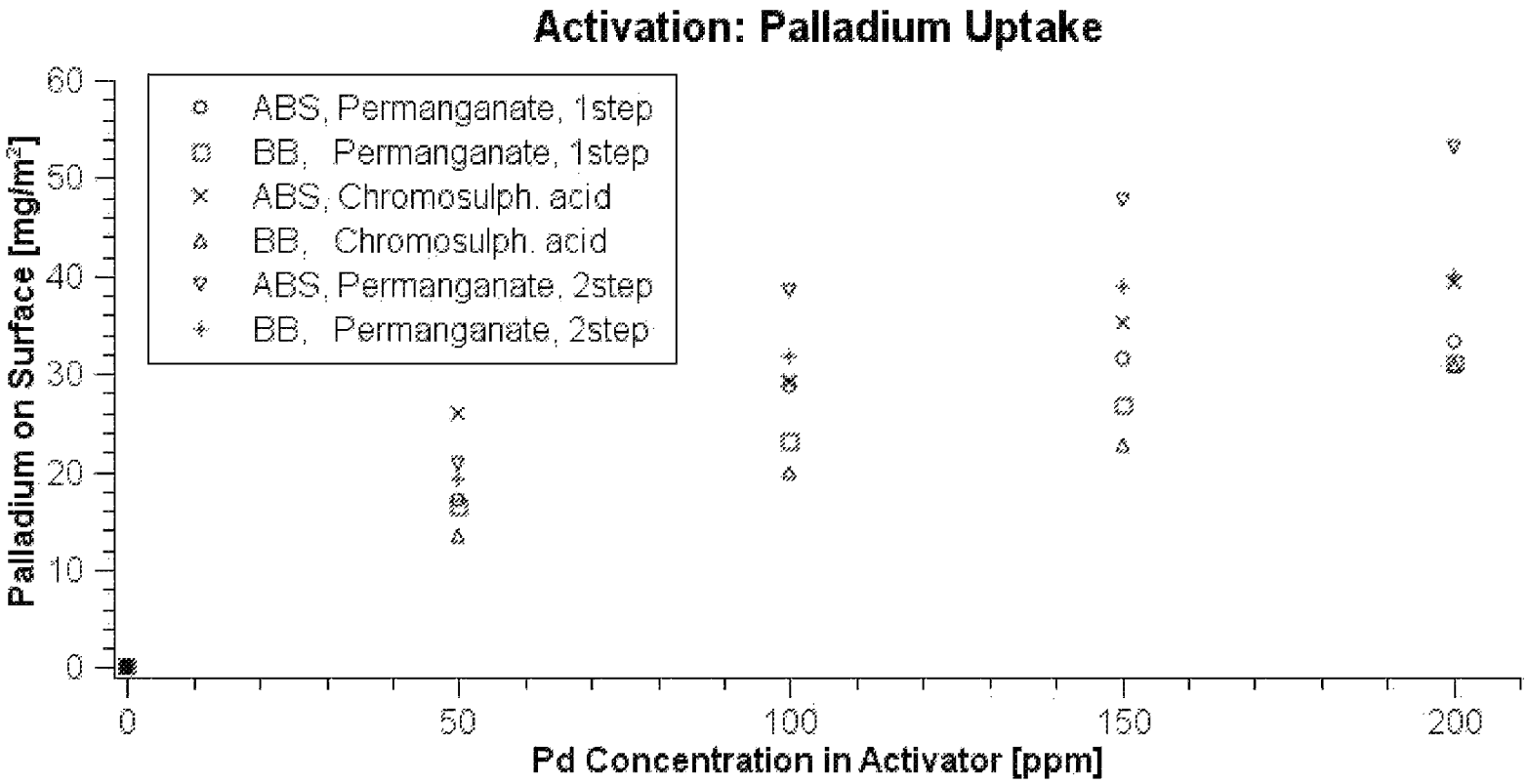
FIG. 1: Influence of treatment of plastic surfaces with various etching treatments on the coverage of the plastic surface with palladium.

The present invention is therefore based on the problem that it has not been possible to date to achieve metallization of articles made from electrically nonconductive plastic in an environmentally safe manner with sufficient process reliability and adhesion strength of the metal layers applied subsequently. Moreover, it has not been possible to date to obtain strongly adhering, large-area metallization of articles made from electrically nonconductive plastic by direct electroplating if the plastic has not been etched with chromosulphuric acid prior to metallization.

It is therefore an object of the present invention to find etching solutions for electrically nonconductive plastic surfaces of articles, these being non-toxic but providing sufficient adhesion strength of the metal layers applied on the plastic surface. It is a further object of the present invention to find etching solutions for electrically nonconductive plastic surfaces of articles which are non-toxic and which enable the direct electroplating of the electrically nonconductive plastic surfaces.

These objects are achieved by the following process according to the invention:

Process for metallizing electrically nonconductive plastic surfaces of articles, comprising the process steps of:

A) treating the plastic surface with etching solutions;

B) treating the plastic surface with a solution of a colloid or of a compound of a metal; and C) metallizing the plastic surface with a metallizing solution;

characterized in that the etching solutions comprise at least one acidic etching solution and at least one alkaline etching solution, and that each of the etching solutions comprise a source for permanganate ions.

Articles in the context of this invention are understood to mean articles which have been manufactured from at least one electrically nonconductive plastic or which have been covered with at least one layer of at least one electrically nonconductive plastic. The articles thus have surfaces of at least one electrically nonconductive plastic. Plastic surfaces are understood in the context of this invention to mean these said surfaces of the articles.

The process steps of the present invention are performed in the sequence specified, but not necessarily in immediate succession. It is possible for further process steps and additionally rinse steps in each case, preferably with water, to be performed between the steps.

The inventive etching of the plastic surfaces with etching solutions comprising at least one acidic etching solution and at least one alkaline etching solution (process step A)) achieves much higher adhesion strengths of the metal layer or metal layers to be applied to the plastic surfaces than the treatments already known, for example with chromosulphuric acid, or known acidic or alkaline permanganate solutions employed individually.

Moreover, the inventive etching of the plastic surface with etching solutions comprising at least one acidic etching solution and at least one alkaline etching solution (process step A)) leads to much higher coverage of the plastic surfaces with a metal during the activation of the plastic surfaces with a solution of a colloid or of a compound of a metal. As a result, not only is metallization of the plastic surfaces without external current subsequently possible, but also the direct electroplating of the plastic surfaces, which means that the plastic surfaces are not metallized without external current but directly metallized by an electrolytic process. These effects are not observed in known etching treatments, for example with chromosulphuric acid, or known acidic or alkaline permanganate solutions employed individually.

The plastic surfaces have been manufactured from at least one electrically nonconductive plastic. In one embodiment of the present invention, the at least one electrically nonconductive plastic is selected from the group comprising an acrylonitrile-butadiene-styrene copolymer (ABS copolymer), a polyamide (PA), a polycarbonate (PC) and a mixture of an ABS copolymer with at least one further polymer.

In a preferred embodiment of the invention, the electrically nonconductive plastic is an ABS copolymer or a mixture of an ABS copolymer with at least one further polymer. The at least one further polymer is more preferably polycarbonate (PC), which means that particularly preferred are ABS/PC mixtures.

In one embodiment of the invention, process step A) may be preceded by performance of the following further process step:

treatment of the rack with a solution comprising a source for iodate ions.

The treatment of the rack with a solution comprising a source for iodate ions is also referred to hereinafter as protection of the rack. The protection of the rack can take place at various times during the process according to the invention. At the time prior to process step A), the articles are not yet fastened to the rack. The rack is thus treated alone, without the articles, with the solution comprising a source for iodate ions.

In a further embodiment of the invention, process step A) may be preceded by performance of the following further process step:

fastening of the article or articles to a rack.

This further process step is referred to hereinafter as fastening step. The fastening of the articles to racks enables the simultaneous treatment of a large number of articles with the successive solutions of the individual process steps, and the establishment of electrical contact connection during the last steps for electrolytic deposition of one or more metal layers. The treatment of the articles by the process according to the invention is preferably performed in a conventional dipping process, by dipping the articles successively into solutions in vessels in which the respective treatment takes place. In this case, the articles may be dipped into the solutions either fastened to racks or introduced into drums. Alternatively, the articles can also be treated in what are called conveyor systems, by lying, for example on trays and being conveyed continuously through the systems in horizontal direction. Fastening to racks is preferred. The racks are generally themselves coated with plastic. The plastic is usually polyvinyl chloride (PVC).

In a further embodiment of the invention, the protection of the rack can be performed prior to the fastening step.

In a further embodiment of the invention, process step A) is preceded by performance of the following further process step:

treating the plastic surface in an aqueous solution comprising at least one glycol compound.

This further process step is referred to hereinafter as pretreatment step. This pretreatment step increases the adhesion strength between the plastic and the metal layer.

If process step A) has additionally been preceded by performance of the fastening step, the pretreatment step is performed between the fastening step and process step A).

A glycol compound is understood to mean compounds of the following general formula (I):

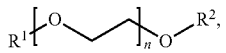

(I)

wherein n is an integer from 1 to 4; and $R^1$ and $R^2$ are each independently —H, —$CH_3$, —$CH_2$—$CH_3$, —$CH_2$—$CH_2$—$CH_3$, —$CH(CH_3)$—$CH_3$, —$CH_2$—$CH_2$—$CH_2$—$CH_3$, —$CH(CH_3)$—$CH_2$—$CH_3$, —$CH_2$—$CH(CH_3)$—$CH_3$, —$CH_2$—$CH_2$—$CH_2$—$CH_2$—$CH_3$, —$CH(CH_3)$—$CH_2$—$CH_2$—$CH_3$, —$CH_2$—$CH(CH_3)$—$CH_2$—$CH_3$, —$CH_2$—$CH_2$—$CH(CH_3)$—$CH_3$, —$CH(CH_2$—$CH_3)$—$CH_2$—$CH_3$, —$CH_2$—$CH(CH_2$—$CH_3)$—$CH_3$, —CO—$CH_3$, —CO—$CH_2$—$CH_3$, —CO—$CH_2$—$CH_2$—$CH_3$, —CO—$CH(CH_3)$—$CH_3$, —CO—$CH(CH_3)$—$CH_2$—$CH_3$, —CO—$CH_2$—$CH(CH_3)$—$CH_3$, —CO—$CH_2$—$CH_2$—$CH_2$—$CH_3$.

According to the general formula (I), the glycol compounds include the glycols themselves and glycol derivatives. The glycol derivatives include the glycol ethers, the glycol esters and the glycol ether esters. The glycol compounds are solvents.

Preferred glycol compounds are ethylene glycol, diethylene glycol, ethylene glycol monomethyl ether acetate, ethylene glycol monoethyl ether acetate, ethylene glycol monopropyl ether acetate, ethylene glycol acetate, diethylene glycol monoethyl ether acetate, diethylene glycol monomethyl ether acetate, diethylene glycol monopropyl ether acetate, butyl glycol, ethylene glycol monobutyl ether, ethylene glycol diacetate and mixtures thereof. Particularly preferred are diethylene glycol monoethyl ether acetate, ethylene glycol acetate, ethylene glycol diacetate, butyl glycol and mixtures thereof.

In the case of use of glycol esters and glycol ether esters, it is advisable to keep the pH of the aqueous solution of the glycol compound within the neutral range by suitable measures, in order to as far as possible suppress the hydrolysis to give the alcohol and carboxylic acid. One example is the hydrolysis of the diethylene glycol monoethyl ether acetate:

$$CH_3—CO—O—CH_2CH_2—O—CH_2CH_2—O—CH_2CH_3+H_2O \rightarrow CH_3—COOH+HO—CH_2CH_2—O—CH_2CH_2—O—CH_2CH_3$$

The water concentration of the solution comprising a glycol compound likewise has an influence on the hydrolysis of the glycol esters and glycol ether esters. However, the solution has to contain water for two reasons: firstly to obtain a noncombustible treatment solution and secondly to be able to adjust the strength of the attack on the plastic surface. A pure solvent, i.e. 100% of a glycol compound, would dissolve most uncrosslinked polymers or at least leave an unacceptable surface. It has therefore been found to be very advantageous to buffer the solution of a glycol ester or glycol ether ester and thus to keep it within the neutral pH range, which means scavenging the protons obtained by hydrolysis of the solvent. A phosphate buffer mixture has been found to be sufficiently suitable for this purpose. The readily soluble potassium phosphates allow sufficiently high concentrations with good buffer capacity at solvent concentrations up to 40% by vol.

The optimal treatment time for the plastic surface depends on the plastic used, the temperature, and the nature and concentration of the glycol compound. The treatment parameters have an influence on the adhesion between the treated plastic surface and the metal layer applied in subsequent process steps. Higher temperatures or concentrations of the glycol compounds also influence the texture of the plastic surface. In any case, it should be possible for the subsequent etching step A) to remove the solvent from the plastic matrix again, because the subsequent steps in the process, more particularly the activation in process step B), are otherwise disturbed. The treatment time in the pretreatment step is between 1 and 30 minutes, preferably between 5 and 20 minutes and more preferably between 7 and 15 minutes.

In Example 8, for an ABS/PC mixture, the influence of the treatment time (residence time) of the plastic surfaces with a glycol solution on the adhesion strength of the metal layer applied subsequently was examined. The results are shown in graph form in FIG. 2. The term "normalized values" in FIG. 2 means: for the adhesion strengths, the original measurements were plotted. For the manganese values, values which had been normalized to the highest manganese measurement were plotted. For the palladium values, values which have been normalized correspondingly to the highest palladium measurement were plotted. All original measurements are summarized in Table 10.2.

Without treatment with glycol compounds (residence time 0 min in FIG. 2), it was not possible to deposit any metal by direct electroplating on the plastic surface. After treatment with glycol compounds for only 4 minutes, in contrast, a good adhesion strength of 0.8 N/mm was already achieved, and this rises with longer treatment time until an optimum is reached.

The treatment temperature is between 20° C. and 70° C., depending on the nature of the solvent or solvent mixture used. Preference is given to a treatment temperature between 20° C. and 50° C., particular preference to a treatment temperature between 20° C. and 45° C.

The treatment of the plastic surfaces in the pretreatment step can be performed in an aqueous solution comprising one glycol compound or in an aqueous solution comprising two or more different glycol compounds. The total concentration of glycol compounds in the aqueous solution is 5% by vol.-50% by vol., preferably 10% by vol.-40% by vol. and more preferably 20% by vol.-40% by vol. If said solution contains one glycol compound, the overall concentration corresponds to the concentration of this one glycol compound. If said solution contains two or more different glycol compounds, the total concentration corresponds to the sum total of the concentrations of all glycol compounds present. In the context of the solution containing at least one glycol compound, the concentration figures for the glycol compound/glycol compounds in % are always understood to mean a concentration in % by vol.

For instance, for pretreatment of ABS plastic surfaces, a solution of 15% by vol. of diethylene glycol monoethyl ether acetate in a mixture with 10% by vol. of butyl glycol at 45° C. has been found to be advantageous. The first solvent therein serves to generate the adhesion strength, while the second, as a nonionic surfactant, increases wettability and helps to remove any soiling present from the plastic surface.

For treatment of ABS/PC mixtures, for example Bayblend T45 or Bayblend T65PG, a solution of 40% by vol. of diethylene glycol monoethyl ether acetate in water at room temperature has been found to be more advantageous, because it allows a higher adhesion strength of the metal layers applied in the case of these plastics (see Example 8).

In a further embodiment of the invention, the protection of the rack can be performed between the fastening step and the pretreatment step. In a further embodiment of the invention, the protection of the rack can be performed between the pretreatment step and process step A). At these times, the articles have already been fastened to the rack. The rack is thus treated together with the articles with the solution comprising a source for iodate ions. Irrespective of whether the protection of the rack takes place alone or together with the articles, it leads to protection of the plastic casing of the racks against metal deposition while the articles which are fastened to the racks during the fastening step are being metallized. The protection of the rack ensures that the plastic casing of the racks is not metallized in the later process steps B) to C), meaning that the racks remain free of metal. This effect is particularly pronounced on a PVC casing of the racks.

The inventive etching treatment in process step A) is performed with etching solutions comprising at least one acidic etching solution and at least one alkaline etching solution.

The acidic etching solution comprises:

1. a source for permanganate ions and
2. an acid.

The alkaline etching solution comprises:

1. a source for permanganate ions and
2. a hydroxide ion source.

The acidic and alkaline etching solutions thus contain a source for permanganate ions. The source for permanganate ions is selected from alkali metal permanganates. The alkali metal permanganates are selected from the group comprising potassium permanganate and sodium permanganate. The source for permanganate ions is selected independently for the acidic and alkaline etching solutions, meaning that the two etching solutions may contain the same source for permanganate ions or the two etching solutions may contain different sources for permanganate ions.

The source for permanganate ions is present in the acidic and alkaline etching solutions in a concentration between 30 g/l and 250 g/l, preferably between 30 g/l and 180 g/l, further preferably between 90 g/l and 180 g/l, more preferably between 90 g/l and 110 g/l and even more preferably between 70 g/l and 100 g/l. Owing to its solubility, potassium permanganate may be present in an etching solution in a concentration of up to 70 g/l. Sodium permanganate may be present in an etching solution in a concentration of up to 250 g/l. The lower concentration limit for each of these two salts is typically 30 g/l. In the acidic etching solution, the content of the source for permanganate ions is preferably between 90 g/l and 180 g/l. In the alkaline etching solution, the content of the source for permanganate ions is preferably between 30 g/l and 100 g/l. The concentration of the source for permanganate ions for the acidic and alkaline etching solutions is selected independently, meaning that the two etching solutions may contain the same concentration of the source for permanganate ions or the two etching solutions may contain different concentrations of the source for permanganate ions.

The acids which are used in the acidic etching solution are preferably inorganic acids. The inorganic acid in the acidic etching solution in process step A) is selected from the group comprising sulphuric acid, nitric acid and phosphoric acid. The acid concentration must not be too high, since the acidic etching solution is otherwise not stable. The acid concentration is between 0.02 and 0.6 mol/l based on a monobasic acid. It is preferably between 0.06 and 0.45 mol/l, more preferably between 0.07 and 0.30 mol/l, based in each case on a monobasic acid. Preference is given to using sulphuric acid in a concentration between 0.035 and 0.15 mol/l, corresponding to an acid concentration between 0.07 and 0.30 mol/l based on a monobasic acid.

In a further embodiment the etching solutions do only contain a source for permanganate ions as described above and an acid as described above. In this embodiment the etching solutions do not contain any further ingredients.

The acidic etching solution can be employed at temperatures between 30° C. and 90° C., preferably between 55° C. and 75° C. It has been found that sufficiently high adhesion strengths between metal layers and plastic surfaces can also be achieved at low temperatures between 30° C. and 55° C. In that case, however, it is not possible to ensure that all solvent from the treatment with glycol compound in the pretreatment step has been removed from the plastic surface. This is particularly true of pure ABS. Thus, if the pretreatment step in the process according to the invention is executed, the temperatures selected in the subsequent process step A) should be selected at a higher level, namely within the range from 55° C. to 90° C., preferably within the range from 55° C. to 75° C.

The optimal treatment time with acidic etching solution depends on the plastic surface being treated and the selected temperature of the etching solution. For ABS and ABS/PC plastic surfaces, the best adhesion strength between plastic surface and subsequently applied metal layer and the best coverage of the plastic surfaces with the metal of the activator are achieved at a treatment time between 5 and 30 minutes, preferably between 10 and 25 minutes and more preferably between 10 and 15 minutes. A longer treatment time than 30 minutes generally leads to no further improvement in the adhesion strengths or in the coverage with metal.

An acidic permanganate solution is very reactive at elevated temperatures, for example at 70° C. The oxidation reaction with the plastic surface then forms many manganese (IV) species which precipitate out. These manganese(IV) species are predominantly manganese(IV) oxides or oxide hydrates and are referred to hereinafter simply as manganese dioxide.

The manganese dioxide precipitate has a disruptive effect on the subsequent metallization if it remains on the plastic surface. During the activation in process step B), it ensures that regions of the plastic surface are not covered with metal colloid or gives rise to unacceptable roughness of the metal layer to be applied in later process steps.

The manganese dioxide also catalyses the reaction of the permanganate with water and can thus lead to instability of the etching solution. The etching solution should therefore advantageously be kept free of manganese dioxide. It has been found that, surprisingly, the formation of manganese dioxide species which are difficult to remove is noticeably decreased when the acid concentration selected in the acidic etching solution is low and the permanganate concentration selected is high.

The hydroxide ion source in the alkaline etching solution in process step A) is selected from the group of alkali metal hydroxides comprising sodium hydroxide, potassium hydroxide and lithium hydroxide. The hydroxide ion source is preferably sodium hydroxide. The hydroxide ion source in the alkaline etching solution is selected independently of the source for permanganate ions, meaning that the alkaline etching solution may comprise a hydroxide ion source and source for permanganate ions with the same alkali metal ion, or the alkaline etching solution may comprise a hydroxide ion source and source for permanganate ions with different alkali metal ions.

The concentration of the hydroxide ion source is between 1 g/l and 100 g/l, preferably between 5 g/l and 50 g/l and more preferably between 10 g/l and 30 g/l.

The alkaline etching solution can be employed at temperatures between 20° C. and 90° C., preferably between 30° C. and 75° C. and more preferably between 30° C. and 60° C. The temperature of the alkaline etching solution has virtually no influence on the degree of coverage of the plastic surfaces with the metal of the activator. In contrast, the treatment of the plastic surfaces with alkaline etching solution within the temperature range between 30° C. and 60° C. leads to higher adhesion strengths. The stability of the alkaline permanganate solution falls somewhat at elevated temperatures. In general, however, the alkaline permanganate solution is much more stable than the acidic permanganate solution. The stability of the alkaline permanganate solution is uncritical within the range between 40° C. and 60° C.

The optimal treatment time with the alkaline etching solution likewise depends on the plastic surface being treated and the selected temperature of an etching solution. For ABS and ABS/PC plastic surfaces, the best adhesion strength between plastic surface and subsequently applied metal layer and the best coverage of the plastic surface with metal from the activator are achieved at a treatment time with the alkaline etching solution between 1 and 20 minutes, preferably between 1 and 15 minutes and more preferably between 1 and 5 minutes. A longer treatment time than 20 minutes generally does not lead to any further improvement in the coverage of the plastic surface with metal from the activator or in the adhesion strengths.

Figure 3A:
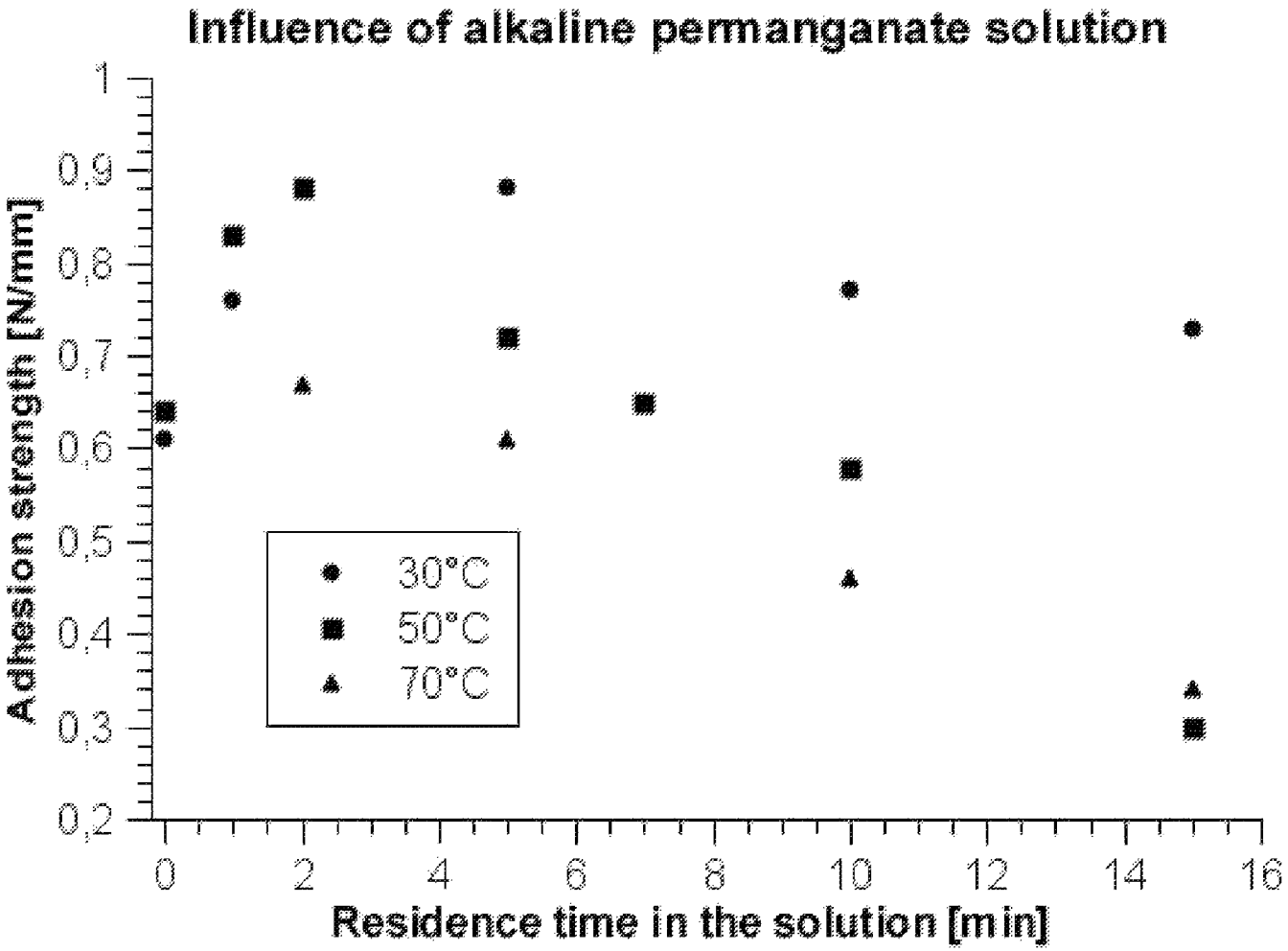
FIG. 3A: Influence of the temperature of an alkaline etching step on adhesion strength if it is executed after an acidic etching step in the metallization process according to the invention.

In Example 9, the influence of the temperature and the treatment time (residence time) in the alkaline permanganate solution on the adhesion strength between the plastic and the metal layer applied by electroplating (by direct electroplating) and the amount of palladium bound during the activation step has been examined by way of example for plastic surfaces formed from an ABS/PC mixture. The adhesion strengths achieved after the etching step in the alkaline permanganate solution at various temperatures are shown in FIG. 3A. According to this, the best adhesion strengths of the metal layer applied by electroplating to ABS/PC mixtures are achieved after 2 to 5 minutes of residence time in the alkaline permanganate solution. Considering the temperatures of the alkaline permanganate solution, the best adhesion strengths are achieved within the range of 30° C. and 50° C. For plastic surfaces formed from ABS/PC mixtures, treatment with alkaline permanganate solution at about 50° C. with a treatment time between one and five minutes is found to be particularly advantageous.

Figure 3B:
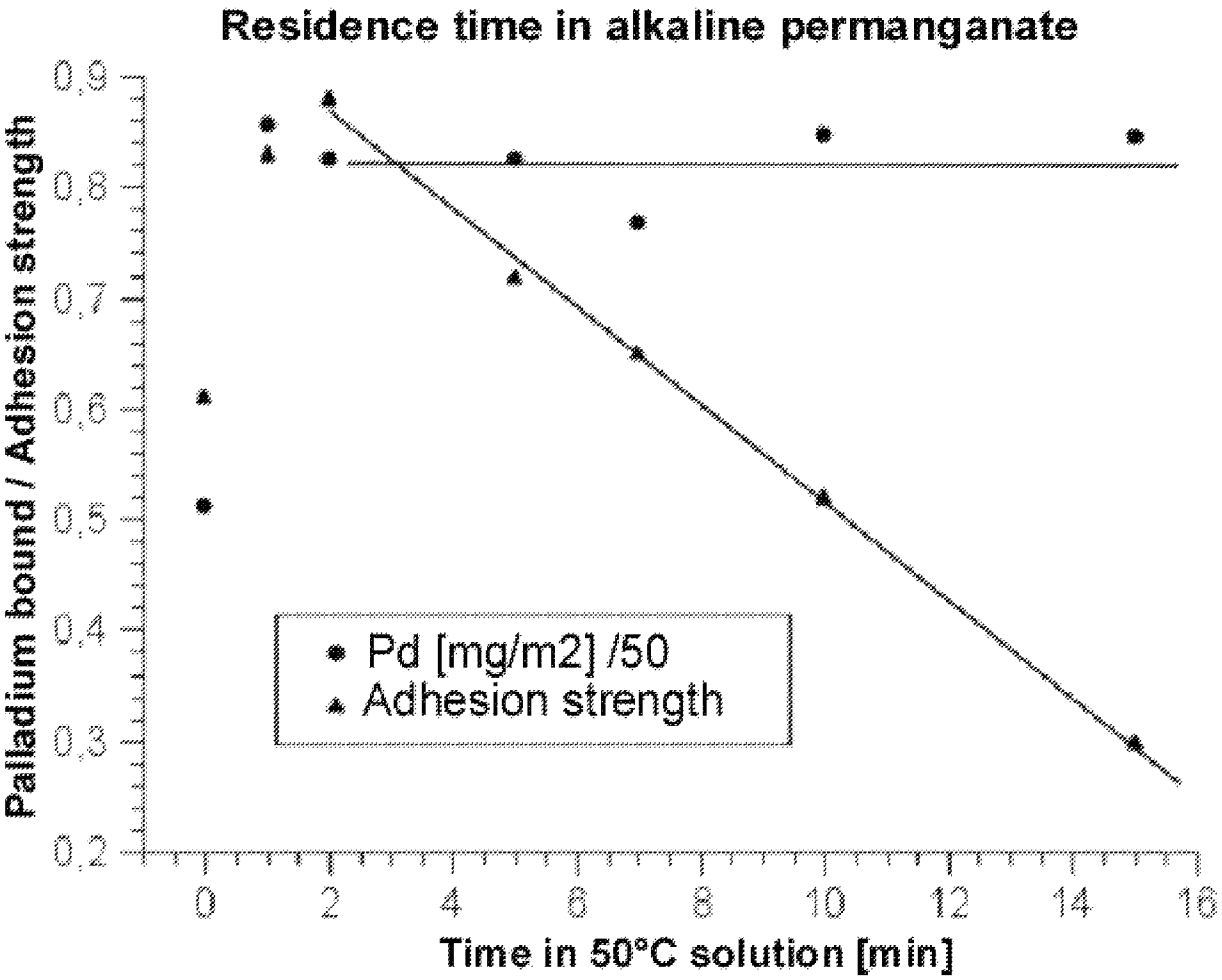
FIG. 3B: Influence of the treatment time of an alkaline etching step on adhesion strength and the amount of palladium bound if it is executed after an acidic etching step in the metallization process according to the invention.

FIG. 3B shows the adhesion strengths and amounts of palladium bound to the surfaces achieved in Example 9 after a treatment with alkaline permanganate solution at 50° C. For better clarity, the amounts of palladium found were divided by a factor of 50 for the graph representation. From a residence time of about one minute in alkaline permanganate solution, the maximum in amount of palladium bound has already been reached; longer residence times in alkaline permanganate solution do not lead to any significant change in the amount of palladium bound on the plastic surface. Treatment with alkaline permanganate solution at about 50° C. for between 1 and 5 minutes is thus also very suitable with regard to the amount of palladium bound for plastic surfaces formed from ABS/PC mixtures.

In process step A), the etching solutions can be used in different sequence. In a particularly preferred embodiment of the present invention, first the acidic etching solution and then the alkaline etching solution is used in process step A), such that process step A) comprises the following steps:

A i) treating the plastic surface with an acidic etching solution, and

A ii) treating the plastic surface with an alkaline etching solution.

In a further preferred embodiment, in process step A), first the alkaline etching solution and then the acidic etching solution is used, such that process step A) comprises the following steps:

A i) treating the plastic surface with an alkaline etching solution, and

A ii) treating the plastic surface with an acidic etching solution.

Examples 1 and 2 describe the effects of the two embodiments. In Example 1, a plastic panel was treated first with an acidic etching solution (acidic permanganate solution) and then with an alkaline etching solution (alkaline permanganate solution), then activated with a palladium colloid and provided with a copper layer by direct electroplating. The plastic panel was covered completely and homogeneously with a copper layer by means of direct electroplating.

In Example 2, plastic panels were treated with an acidic and an alkaline etching solution in both abovementioned sequences. Subsequently, the panels were activated with a palladium colloid, nickel-plated electrolessly and copper-plated electrolytically. Plastic panels which had been etched with an acidic and an alkaline etching solution in both abovementioned sequences were provided with a copper layer. The panels which had been etched first with an alkaline and subsequently with an acidic etching solution were likewise covered with a copper layer, although it was not entirely complete. The adhesion strength of the resulting metal layers on the plastic panels was determined in accordance with the standard ASTM B 533 1985 Reapproved 2009 by the peel test as described in Example 2. The adhesion strengths achieved in the deposited metal layers were well above those achievable after treatment with a single acidic etching solution or a single alkaline etching solution or a chromosulphuric acid solution from the prior art (see Comparative Example 3). Plastic panels which had been etched first with an acidic and subsequently with an alkaline etching solution exhibited higher adhesion strengths than the plastic panels which had been etched first with an alkaline and subsequently with an acidic etching solution.

Alternatively, in process step A), it is possible to perform more than two steps for treatment of the plastic surfaces with etching solutions. For example, the first two steps in process step A) may each comprise the treatment of the plastic surfaces with acidic etching solutions, and a third step comprises the treatment of the plastic surfaces with an alkaline etching solution. Or the first two steps in process step A) each comprise the treatment of the plastic surfaces with alkaline etching solutions and a third step comprises the treatment of the plastic surfaces with an acidic etching solution. Or process step A) comprises three steps for treatment of the plastic surfaces with etching solutions, using acidic and alkaline etching solutions alternately in each case. Process step A) may also comprise more than three steps for treatment of the plastic surfaces with etching solutions. Irrespective of the number of steps and the sequence thereof which are performed in process step A), it is important that process step A) always comprises at least one step for treatment of the plastic surfaces with an acidic etching solution and at least one step for treatment of the plastic surfaces with an alkaline etching solution. Particular preference is given to embodiments in which, in process step A), the first step in each case consists in the treatment of the plastic surfaces with an acidic etching solution and the last step in each case in the treatment of the plastic surfaces with an alkaline etching solution.

Regular, generally daily, analysis for constituents of the etching solutions is advantageous in order to optimize process reliability. This includes the titration of the acid or of the base to obtain the original acid concentration or hydroxide ion concentration, and the photometric determination of the permanganate concentration. The latter can be effected with a simple photometer. The light from green light-emitting diodes (wavelength $\lambda$=520 nm) corresponds quite accurately to the absorption maximum of permanganate. The consumptions then have to be added according to the analytical data. Experiments have shown that, in the step for treatment of the plastic surfaces with an acidic etching solution in process step A) at the recommended operating temperature within a reaction time of 10 minutes, about 0.7 g/m$^2$ to 1.2 g/m$^2$ of manganese dioxide forms on the surface of ABS plastics. Compared to the losses resulting from drag-out of permanganate solution by the articles, this consumption in the surface reaction is negligible.

The inventive etching solutions do not contain any chromium or chromium compounds; the etching solutions contain neither chromium(III) ions nor chromium(VI) ions. The inventive etching solutions are thus free of chromium or chromium compounds; the etching solutions are free of chromium (III) ions and chromium(VI) ions.

The inventive etching of the plastic surface with etching solutions comprising at least one acidic etching solution and at least one alkaline etching solution (process step A)) achieves much higher adhesion strengths of the metal layer or metal layers to be applied to the plastic surfaces than the treatments already known, for example with chromosulphuric acid, or known acidic or alkaline permanganate solutions employed individually.

For the treatment of the plastic surfaces with an acidic etching solution, an etching solution whose acid concentration is low and whose permanganate concentration is high is used. Thus, it is possible to adjust the formation of manganese dioxide species such that the stability of the etching solution is ensured and a distinct contribution to higher adhesion strength is nevertheless achieved. The individual or sole treatment of the plastic surfaces with alkaline permanganate solutions, as used routinely in the circuit board industry as the etching solution, is unsuitable for the present object since it does not give sufficient adhesion strength between plastic surface and metal layer.

Process step A) of the invention comprises the treatment of the plastic surface with etching solutions comprising at least one acidic etching solution and at least one alkaline etching solution, and thus constitutes a combination of steps for treatment of plastic surfaces with different etching solutions. The inventive combination of steps for treatment of plastic surfaces with at least one acidic etching solution and at least one alkaline etching solution achieves much higher adhesion strengths of the metal layer or metal layers to be applied to the plastic surfaces than the treatments already known, for example with chromosulphuric acid, or known acidic or alkaline permanganate solutions employed individually.

As already described, in Example 2, adhesion strengths have been determined for metal layers on plastic surfaces, these having been produced by two preferred embodiments of the metallization process according to the invention. In Example 3, ABS/PC plastic panels were etched in different ways: one group of the plastic panels with an acidic etching solution of the present invention, one group with an alkaline etching solution of the present invention and one group with chromosulphuric acid (known from the prior art). Subsequently, all panels were activated with palladium colloid, then nickel-plated electrolessly, then copper-plated electrolytically, and the adhesion strength of the metal layers on the plastic panels was determined, as described in Example 2. The adhesion strength values obtained in Examples 2 and 3 for plastic panels metallized without external current are summarized in Table 1.

The best adhesion strengths were obtained for plastic panels which have been etched first with an acidic etching solution and then with an alkaline etching solution (etching treatment I. in Table 1). After the etching of panels in the reverse sequence (first alkaline etching solution, then acidic etching solution, etching treatment II. in Table 1), adhesion strengths below those which have been obtained after an individual acidic etching step (acidic etching solution, etching treatment III. in Table 1) were achieved. However, the adhesion strengths after etching treatment II. are well above those after etching with an individual alkaline etching step (etching treatment IV. in Table 1) or etching with chromosulphuric acid (etching treatment V. in Table 1). The comparison of etching treatments I., III. and IV shows that the first acidic etching step in the inventive etching treatment I. already contributes a large proportion to the improvement in adhesion strength. The alkaline etching step executed subsequently, however, leads to a distinct, additional increase in adhesion strength. This effect was surprising since an alkaline etching step executed individually (etching treatment IV.) does not lead to any significant adhesion strength (see Table 1). Although lower adhesion strengths were obtained after etching with etching treatment II. (first alkaline etching solution, then acidic etching solution) than after etching with inventive etching treatment I. (first acidic, then alkaline), the inventive etching treatment II. does achieve much better adhesion strengths than the known etching treatment IV. (only alkaline etching solution) or the known etching treatment V. (chromosulphuric acid), which was likewise surprising.

TABLE 1

Adhesion strengths of metal layers applied without external current on plastic surfaces after various etching treatments.

| Etching treatment | Etching solutions | Adhesion strength measurement 1/N/mm | Adhesion strength measurement 2/N/mm | Mean adhesion strength/ N/mm |
|---|---|---|---|---|
| I. | 1. acidic permanganate solution 2. alkaline permanganate solution | 1.41 | 1.24 | 1.32 |
| II. | 1. alkaline permanganate solution 2. acidic permanganate solution | 1.01 | 0.95 | 0.98 |
| III. | acidic permanganate solution | 1.09 | 1.32 | 1.21 |
| IV. | alkaline permanganate solution | 0* | 0.25 | — |
| V. | chromosulphuric acid | 0.45 | 0.70 | 0.58 |

*Bubbles between metal layer and plastic surface.

In Example 5, plastic panels made from an ABS/PC mixture were treated with etching treatments I., III., IV. and V., activated with a palladium colloid, then provided with a copper layer by direct electroplating, and then the adhesion strength of the copper layer applied was determined as described in Example 2. The adhesion strength values obtained in Example 5 for plastic panels metallized by direct electroplating are summarized in Table 8.2.

The adhesion strengths obtained after direct electroplating in Example 5 for all etching treatments were lower than the adhesion strengths for the metal layers applied by metallization without external current in Examples 2 and 3. It is a known effect that the adhesion strengths of metal layers on plastic surfaces after direct metallization are generally lower than for a metallization without external current. This effect is also observed here. The adhesion strengths in Example 5, in qualitative terms, show the same behaviour as in Examples 2 and 3. The best adhesion strengths were obtained for the plastic panels which had been etched with the inventive etching treatment I. (first acidic etching solution, then alkaline etching solution) (Table 8.2). The comparison of etching treatments I., III. and IV., even in the case of direct electroplating, shows the interaction of a first acidic etching step and a subsequent alkaline etching step already outlined for Examples 2 and 3 in the inventive etching treatment I., this resulting in the particularly good adhesion strength of the metal layer applied. The combination of the acidic etching step with an alkaline etching step (inventive etching treatment I.) leads to a higher adhesion strength than an acidic etching treatment III. executed individually. The combination of the acidic etching step with an alkaline etching step (inventive etching treatment I.) further leads to much better adhesion strengths than with the known etching treatment IV. (only alkaline etching solution) or the known etching treatment V. (chromosulphuric acid).

The process according to the invention gives adhesion strengths of at least 0.8 N/mm when the metal layers are applied to the plastic surfaces with the aid of metallization without external current. If the metal layers are applied to the plastic surfaces by direct electroplating, the process according to the invention gives adhesion strengths of at least 0.6 N/mm. Thus, the adhesion strengths achieved by the process according to the invention are well above the required minimum value of 0.4 N/mm.

Moreover, the inventive etching of the plastic surface with etching solutions comprising at least one acidic etching solution and at least one alkaline etching solution (process step A)) leads to much higher coverage of the plastic surfaces with a metal during the activation of the plastic surfaces with a solution of a colloid or of a compound of a metal. This effect is particularly pronounced when the activation is performed with a metal colloid. Thus, firstly, not only is metallization of the plastic surfaces without external current subsequently possible, but also the direct electroplating of the plastic surfaces, meaning that the plastic surfaces are not metallized without external current but directly metallized by an electrolytic process. Secondly, this makes it possible to lower the concentration of the metal in the metal colloid or in the solution of a compound of a metal. In spite of the low metal concentration in the solution of a colloid or of a compound of a metal, metallization of the plastic surfaces without external current or else the direct electroplating of the plastic surfaces is subsequently possible. These effects are not observed in the case of known etching treatments, for example with chromosulphuric acid, or known acidic or alkaline permanganate solutions employed individually.

In Example 4, plastic panels made of ABS and an ABS/PC mixture were etched by etching treatments I. (first acidic etching solution, then alkaline etching solution), III. (only acidic etching solution) and V. (chromosulphuric acid), and activated with solutions of a colloidal activator with different palladium concentrations. After the activation, the palladium bound on the surface of the panels was dissolved in a defined volume of aqua regia, and the palladium concentration therein was determined by optical emission spectrometry with inductively coupled plasma (ICP-OES).

The measurement principle of ICP-OES involves atomizing a sample present in solution and inducing the ions present to emit light by means of an inductively coupled plasma. The light emitted is divided into its wavelengths and the intensity thereof is measured by means of a spectrometer. The ions present can be identified and quantified on the basis of their emission lines. ICP-OES is known to those skilled in the art for determination of metal ions in solutions. The performance of the ICP-OES measurements is described in Example 4. The values of surface-bound palladium for various plastic panels and various etching treatments are summarized in Table 7, and shown in graph form in FIG. 1. In FIG. 1, the following terms have the following meanings:

ABS: ABS copolymer

BB: Bayblend T45, an ABS/PC mixture

Permanganate, 1 step: Treatment with acidic permanganate solution corresponding to etching treatment III.

Permanganate, 2 steps: Treatment first with acidic permanganate solution, then with alkaline permanganate solution corresponding to etching treatment I.

For plastic panels made from an ABS/PC mixture which has been etched with a combination of initial treatment with acidic etching solution and subsequently with alkaline etching solution (inventive etching treatment I., see Table 7 and FIG. 1), for all palladium concentrations in the activator, a much higher palladium loading of the plastic surface was obtained than for ABS/PC panels which had been etched by an individual acidic etching step (etching treatment III., acidic etching solution) or with chromosulphuric acid (etching treatment V.).

For plastic panels made from ABS which have been etched by a combination of initial treatment with acidic etching solution and subsequently with alkaline etching solution (inventive etching treatment I., see Table 7 and FIG. 1), a much higher palladium loading of the plastic surface was obtained at palladium concentrations of 100 ppm to 200 ppm in the activator than for ABS panels which have been etched by a single acidic etching step (etching treatment III., acidic etching solution) or with chromosulphuric acid (etching treatment V.).

Combined etching with an acidic and an alkaline etching solution thus surprisingly leads to the effect that much more palladium from the activator is deposited on the plastic surfaces. Therefore, combined etching with an acidic and an alkaline etching solution allows activation of the plastic surfaces firstly for a subsequent metallization without external current. Secondly, a directly subsequent electrolytic metallization (direct electroplating) is also possible through the combined etching with an acidic and an alkaline etching solution. As described at the outset, direct electroplating generally requires higher coverage of the plastic surfaces with metal, i.e., for example, palladium, than metallization of plastic surfaces without external current. The possibility of being able to successfully undertake metallization of the plastic surfaces by direct electroplating after the inventive etching treatment with an acidic and an alkaline permanganate solution is thus opened up by the effect of the inventive etching treatment, namely that of higher metal coverage from the activator.

After the combined etching with an acidic and an alkaline permanganate solution, the surfaces of the various plastics were treated with activators which had different palladium concentrations. The advantageous effect observed in the higher palladium coverage of the plastic surfaces was tested and observed within the concentration range from 50 ppm or above 50 ppm to 200 ppm of palladium in the activator. The concentration of palladium in the activator can thus be lowered to a range between 50 ppm and 100 ppm. In spite of this low palladium concentration in the activator, metallization of the plastic surfaces without external current or even the direct electroplating of the plastic surfaces is subsequently possible.

In Example 6, the absorption of palladium on surfaces of panels of an ABS/PC mixture was additionally measured after various etching treatments. The ABS/PC panels were etched by etching treatment I. (first acidic etching solution then alkaline etching solution) and etching treatment IV. (only alkaline etching solution), then treated with a colloidal palladium activator, then the palladium bound on the surface of the differently etched plastic panels was removed again by aqua regia and the palladium concentration in the resulting solution was determined as described in Example 4. The results achieved are reported in Example 6.

On panels which had been etched by the inventive etching treatment I., considerably more surface-bound palladium was found than on panels which had been treated by etching treatment IV. These results can be compared with those from Example 4 for the palladium coverage of ABS/PC panels after etching by inventive etching treatment I. and etching treatment III. (only acidic etching solution).

In Example 4, much higher amounts of palladium per unit area were found on ABS/PC panels for all palladium concentrations in the activator when the panels had been treated by inventive etching treatment I. than when the panels had been treated by an individual acidic etching step in etching treatment III. This gives rise to a similar effect to that for the adhesion strengths achieved, which have already been discussed. Neither an individual acidic etching step nor an individual alkaline etching step can lead to increased metal coverage of the plastic surfaces from the activator. Only the combination of an acidic etching step with an alkaline etching step gives rise to the advantageous effect of the much higher metal coverage of the plastic surfaces after the activation. It is found that a first acidic etching step in the inventive etching treatment I. makes a high contribution to the palladium coverage. However, a subsequently executed alkaline etching step leads to a distinct, additional increase in the palladium coverage. This effect was surprising since an individually executed alkaline etching step (etching treatment IV.) does not lead to any significant palladium coverage of plastic surfaces (see values in Example 6).

In a further embodiment, the articles, after the permanganate treatment in process step A), are cleaned by rinsing off excess permanganate solution. The rinsing is effected in one or more, preferably three, rinsing steps with water.

In a further preferred embodiment of the invention, the following further process step is performed between process steps A) and B):

A iii) treating the plastic surface in a solution comprising a reducing agent for manganese dioxide.

The further process step A iii) is also referred to as reduction treatment. This reduction treatment reduces manganese dioxide adhering to the plastic surfaces to water-soluble manganese(II) ions. The reduction treatment is conducted after the permanganate treatment in process step A) and optionally after the rinsing. For this purpose, an acidic solution of a reducing agent is used. The reducing agent is selected from the group comprising hydroxylammonium sulphate, hydroxylammonium chloride and hydrogen peroxide. Preference is given to an acidic solution of hydrogen peroxide because hydrogen peroxide is neither toxic nor complex-forming. The content of hydrogen peroxide in the solution of the reduction treatment (reduction solution) is between 25 ml/l and 35 ml/l of a 30% hydrogen peroxide solution (% by weight), preferably 30 ml/l of a 30% hydrogen peroxide solution (% by weight).

The acid used in the reduction solution is an inorganic acid, preferably sulphuric acid. The acid concentration is 0.4 mol/l to 5.0 mol/l, preferably 1.0 mol/l to 3.0 mol/l, more preferably 1.0 mol/l to 2.0 mol/l, based in each case on a monobasic acid. In the case of use of sulphuric acid, particular preference is given to concentrations of 50 g/l 96% sulphuric acid to 100 g/l 96% sulphuric acid, corresponding to an acid concentration of 1.0 mol/l to 2.0 mol/l based on a monobasic acid.

The reduction treatment removes the manganese dioxide precipitate which disrupts the metallization of the articles. As a result, the reduction treatment of process step A iii) promotes the homogeneous and continuous coverage of the articles with the desired metal layer and promotes the adhesion strength and smoothness of the metal layer applied to the articles.

The reduction treatment in process step A iii) likewise has an advantageous effect on the metallization of the plastic casing of the rack. The unwanted coverage of the plastic casing with palladium during process step B) is suppressed. This effect is particularly pronounced when the reduction solution comprises a strong inorganic acid, preferably sulphuric acid. Hydrogen peroxide is preferred over hydroxylammonium sulphate or chloride in the reduction solution also because it better suppresses rack metallization.

The reduction treatment in process step A iii) is performed at a temperature between 30° C. and 50° C., preferably at 40° C. to 45° C. The reduction treatment is performed for a period between 1 and 10 minutes, preferably between 3 and 6 minutes. In order to achieve sufficient protection of the racks prior to activation, it is advantageous to increase the treatment time in the reduction solution to 3 to 10 minutes, preferably to 3 to 6 minutes.

The hydrogen peroxide reducing agent used has to be replenished from time to time. The consumption of hydrogen peroxide can be calculated from the amount of manganese dioxide bound to the plastic surfaces. In practice, it is sufficient to observe the evolution of gas in the course of the reduction reaction during process step A iii) and to meter in the original amount of hydrogen peroxide, for example 30 ml/l of a 30% solution, when the evolution of gas abates. At elevated operating temperature of the reduction solution, for example at 40° C., the reaction is rapid and is complete after one minute at most.

Moreover, it has been found that, surprisingly, in the case of deposition of an increasing amount of manganese dioxide on the plastic surface in process step A) (etching), the coverage of the plastic surface with metal colloid in the later activation (process step B)) increases when the deposited manganese dioxide is removed from the plastic surface inbetween, in process step A iii) (reduction treatment). As described in the section regarding process step A) (etching), higher concentrations of sulphuric acid in the acidic etching solution lead to the advantageous deposition of an increasing amount of manganese dioxide on the plastic surface. At the same time, higher concentrations of sulphuric acid in the acidic etching solution, however, also have the adverse effect that the increasing amount of manganese dioxide distinctly impairs the stability of the acidic etching solution, and deposits of manganese dioxide have to be removed again to an increased extent from the plastic surface after the etching (process step A). The level of the sulphuric acid concentration in the acidic etching solution thus leads to opposing effects which have both positive and negative effects on the quality of the metal layer ultimately to be applied to the plastic surface. The concentration range of the inorganic acid specified in the section regarding process step A) (etching), and particularly that for sulphuric acid in the acidic etching solution, is thus the concentration window within which the adverse effects are very substantially suppressed, while the advantageous effects are supported to the best possible extent.

The combination of the etching of the plastic surfaces in an acidic etching solution and in an alkaline etching solution leads to a further increase in the amount of the manganese dioxide deposited on the plastic surfaces. This is shown in Example 7 for plastic panels made from ABS and an ABS/PC mixture. The amount of the manganese dioxide deposited on the plastic panels was again determined with the aid of ICP- OES, as described in Examples 4 and 7. The amount of manganese dioxide deposited is much higher after the inventive etching treatment I. (first acidic etching solution, then alkaline etching solution) than after an individual acidic etching step (etching treatment III.).

The effect that, in the case of deposition of an increasing amount of manganese dioxide on the plastic surface in process step A) (etching), in the later activation (process step B)), the coverage of the plastic surface with metal from the activator increases when the manganese dioxide deposited is removed from the plastic surface in the meantime, in process step A iii) (reduction treatment), is shown by Example 8. In Example 8, the influence of the residence time of plastic surfaces in solutions of glycol compounds on adhesion strengths, and on amounts of manganese dioxide deposited and of palladium bound, is examined. The results from Example 8 are shown in graph form in FIG. 2. The term "normalized values" in FIG. 2 has already been explained above. All original measurements are summarized in Table 10.2. The amount of manganese found on the plastic surface is a measure of the amount of manganese dioxide bound during the etching.

Figure 2:
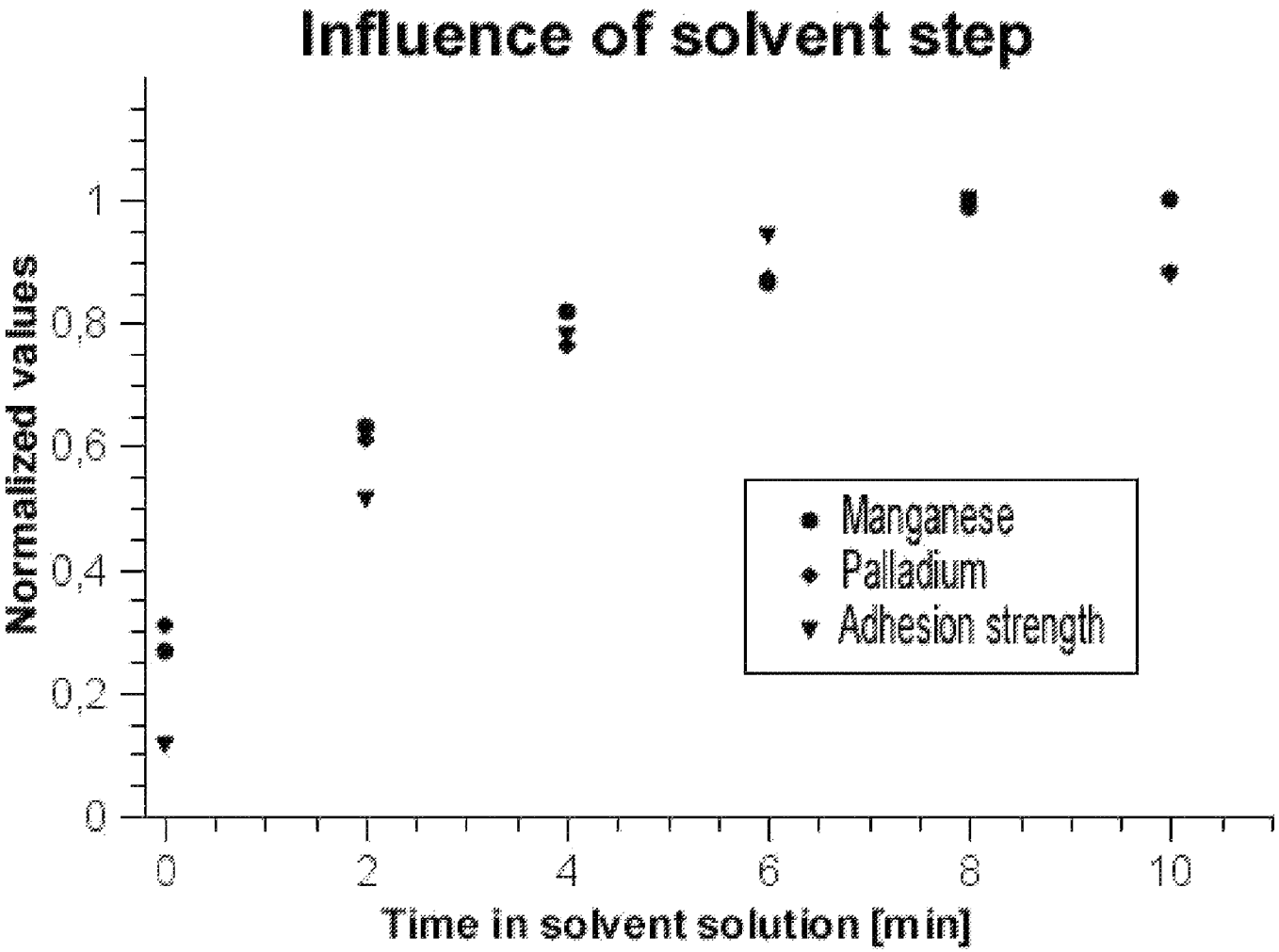
FIG. 2: Influence of the treatment time of plastic surfaces with solutions of glycol compounds on the adhesion strengths of metal layers applied subsequently, on amounts of manganese dioxide deposited and on amounts of palladium bound.

It can be inferred from FIG. 2 that, with rising residence time of the plastic surfaces in glycol solutions, the amount of manganese dioxide deposited on the plastic surface also increases. The respective amounts of magnesium deposited on the plastic surface are also attributed to the amounts of the palladium bound on the plastic surfaces from a palladium activator. FIG. 2 shows clearly that with increasing amount of deposited manganese dioxide, the amounts of palladium bound to the plastic surfaces also increase.

For the industrial scale use of the metallization of plastic surfaces, the articles are usually fastened to racks. These are metal carrier systems which allow the simultaneous treatment of a large number of articles with the successive solutions of the individual process steps and last steps for electrolytic deposition of one or more metal layers. The racks are generally themselves coated with plastic. Therefore, the racks in principle likewise constitute a substrate for metallization processes on plastic surfaces.

However, the additional metallization of the racks is undesirable since the metal layers have to be removed again from the racks after the coating of the articles. This means additional cost and inconvenience for the removal, combined with additional consumption of chemicals. Moreover, the productivity of the metallization plant in this case is lower since the racks first have to be demetallized prior to refilling with articles.

In the case of use of chromic acid-containing etchant, this problem is much reduced. During the etching, the chromic acid also penetrates into the plastic casing of the racks and diffuses back out of these during the subsequent process steps, thus preventing the metallization of the rack. If the intention is to replace toxic chromosulphuric acid for etching treatment of plastics with more environmentally safe process steps, it is advantageous also to prevent the unwanted metallization of the racks.

In a further embodiment of the invention, the protection of the rack can be conducted between process step A) and process step B), preferably between process steps A iii) and A iv).

Irrespective of the time of protection of the rack among the times described in the process according to the invention, it leads to protection of the plastic casing of the racks from the metal deposition, while the articles which are fastened to the racks during the fastening step are metallized.

Treatment with iodate ions is particularly advantageous when process step B ii), in one embodiment of the invention, consists of electroless metallizing of the articles in a metallization solution.

The protection of the rack with a solution comprising a source for iodate ions is executed at a temperature of 20° C. to 70° C., more preferably of 45° C. to 55° C. Preferably the process step of protection of the rack is performed by treating the rack with a solution comprising iodate ions. Suitable sources of iodate ions are metal iodates. The metal iodates are selected from the group comprising sodium iodate, potassium iodate, magnesium iodate, calcium iodate and the hydrates thereof. The concentration of the metal iodates is between 5 g/l and 50 g/l, preferably from 15 g/l to 25 g/l. The duration of the treatment of the rack with iodate ions is between 1 and 20 minutes, preferably between 2 and 15 minutes and more preferably between 5 and 10 minutes. The solution comprising a source for iodate ions may further comprise an acid. Preference is given to inorganic acids selected from the group comprising sulphuric acid and phosphoric acid, preferably sulphuric acid. The acid concentration is 0.02 mol/l to 2.0 mol/l, preferably 0.06 mol/l to 1.5 mol/l, more preferably 0.1 mol/l to 1.0 mol/l, based in each case on a monobasic acid. In the case of use of sulphuric acid, particular preference is given to concentrations of 5 g/l 96% sulphuric acid to 50 g/l 96% sulphuric acid, corresponding to an acid concentration of 0.1 mol/l to 1.0 mol/l based on a monobasic acid.

The process of the present invention further comprises process step B), in which a plastic surface is treated with a solution of a metal colloid or of a compound of a metal.

The metal of the metal colloid or the metal compound is selected from the group comprising the metals of transition group I of the periodic table of the elements (PTE) and transition group VIII of the PTE.

The metal of transition group VIII of the PTE is selected from the group comprising palladium, platinum, iridium, rhodium and a mixture of two or more of these metals. The metal of transition group I of the PTE is selected from the group comprising gold, silver and a mixture of these metals.

A preferred metal in the metal colloid is palladium. The metal colloid is stabilized with a protective colloid. The protective colloid is selected from the group comprising metallic protective colloids, organic protective colloids and other protective colloids. As a metallic protective colloid, preference is given to tin ions. The organic protective colloid is selected from the group comprising polyvinyl alcohol, polyvinylpyrrolidone and gelatin, preferably polyvinyl alcohol.

In a preferred embodiment of the invention, the solution of the metal colloid in process step B) is an activator solution with a palladium/tin colloid. This colloid solution is obtained from a palladium salt, a tin(II) salt and an inorganic acid. A preferred palladium salt is palladium chloride. A preferred tin(II) salt is tin(II) chloride. The inorganic acid may consist in hydrochloric acid or sulphuric acid, preferably hydrochloric acid. The colloid solution forms through reduction of the palladium chloride to palladium with the aid of the tin(II) chloride. The conversion of the palladium chloride to the colloid is complete; therefore, the colloid solution no longer contains any palladium chloride.

If, in the subsequent process steps, the plastic surfaces are metallized electrolessly, the concentration of palladium in the colloid solution is 5 mg/l-100 mg/l, preferably 20 mg/l-50 mg/l and more preferably 30 mg/l-45 mg/l, based on $Pd^{2+}$.

If the plastic surfaces in the subsequent process steps are metallized by means of direct electroplating, the concentration of palladium in the colloid solution is 50 mg/l-200 mg/l, preferably 75 mg/l-150 mg/l, more preferably 100 mg/l-150 mg/l, and more preferably 80 mg/l-120 mg/l, based on $Pd^{2+}$.

The concentration of tin(II) chloride is 0.5 g/l-10 g/l, preferably 1 g/l-5 g/l and more preferably 2 g/l-4 g/l, based on $Sn^{2+}$. The concentration of hydrochloric acid is 100 ml/l-300 ml/l (37% by weight of HCl). In addition, a palladium/tin colloid solution additionally comprises tin(IV) ions which form through oxidation of the tin(II) ions. The temperature of the colloid solution during process step B) is 20° C.-50° C. and preferably 35° C.-45° C. The treatment time with the activator solution is 0.5 min-10 min, preferably 2 min-5 min and more preferably 3 min-5 min.

In a further embodiment of the invention, in process step B), the solution of a compound of a metal is used in place of the metal colloid. The solution of a metal compound used is a solution comprising an acid and a metal salt. The metal in the metal salt consists in one or more of the above-listed metals of transition groups I and VIII of the PTE. The metal salt may be a palladium salt, preferably palladium chloride, palladium sulphate or palladium acetate, or a silver salt, preferably silver acetate. The acid is preferably hydrochloric acid. Alternatively, it is also possible to use a metal complex, for example a palladium complex salt, such as a salt of a palladium-aminopyridine complex. The metal compound in process step B) is present in a concentration of 40 mg/l to 80 mg/l, based on the metal. The solution of the metal compound can be employed at a temperature of 25° C. to 70° C., preferably at 25° C. The treatment time with the solution of a metal compound is 0.5 min-10 min, preferably 2 min-6 min and more preferably 3 min-5 min.

Between process steps A) and B), the following further process step can be performed: A iv) Treating the plastic surface in an aqueous acidic solution.

Preference is given to performing process step A iv) between process steps A iii) and B). If, in the process according to the invention, process step A iii) was followed by the protection of the racks, process step A iv) is more preferably performed between the protection of the racks and process step B).

The treatment of the plastic surfaces in process step A iv) is also referred to as preliminary dipping, and the aqueous acidic solution used as a preliminary dipping solution. The preliminary dipping solution has the same composition as the colloid solution in process step B), without the presence of the metal in the colloid and the protective colloid thereof. The preliminary dipping solution, in the case of use of a palladium/tin colloid solution in process step B), comprises exclusively hydrochloric acid if the colloid solution likewise comprises hydrochloric acid. For preliminary dipping, brief immersion into the preliminary dipping solution at ambient temperature is sufficient. Without rinsing the plastic surfaces, they are treated further directly with the colloid solution of process step B) after the treatment in the preliminary dipping solution.

Process step A iv) is preferably performed when process step B) involves the treatment of a plastic surface with a solution of a metal colloid. Process step A iv) can also be performed when process step B) involves the treatment of a plastic surface with a solution of a compound of a metal.

After the treatment of the plastic surfaces with the metal colloid or the metal compound in process step B), these can be rinsed.

In a further embodiment of the invention, the plastic surfaces are metallized electrolessly in the subsequent process steps. In this embodiment, between process steps B) and C), the following further process steps are performed:

B i) Treating the plastic surface in an aqueous acidic solution and

B ii) Electrolessly metallizing the plastic surface in a metallization solution.

The embodiment is shown schematically in Table 2.

TABLE 2

Embodiment of plastic metallization

| Process step | Constituents | Time | Temperature |
|---|---|---|---|
| A) Etching: A i) | 100 g/l sodium permanganate, 10 g/l 96% sulphuric acid | 5-15 min | 70° C. |
| A ii) | 30 g/l $NaMnO_4$, 20 g/l NaOH | 10-25 min | 30-90° C. |
| A iii) Reduction | 100 g/l 96% sulphuric acid, 30 ml/l hydrogen peroxide, 30% by wt. | 1 min | 45° C. |
| A iv) Preliminary dipping | Hydrochloric acid, about 10% by wt. | 1 min | 20° C. |
| B) Activation | Palladium/tin colloid in hydrochloric acid solution, 5 mg/l-100 mg/l Pd | 3-6 min | 20-45° C. |
| B i) Acceleration | Sulphuric acid (5%) | 2-6 min | 40-50° C. |
| B ii) Electroless metal deposition | Chemically reductive nickel-plating or copper-plating | 6-20 min | 30-50° C. |
| C) Metal deposition | For example, electrochemical copper-plating or nickel-plating | 15-70 min | 20-35° C. |

These further process steps B i) and B ii) are employed when the articles are to be metallized by an electroless metallization process, i.e. a first metal layer is to be applied to the plastic surfaces by an electroless process.

If the activation in process step B) has been performed with a metal colloid, the plastic surfaces are treated in process step B i) with an accelerator solution in order to remove constituents of the colloid in the colloid solution, for example a protective colloid, from the plastic surfaces. If the colloid in the colloid solution in process step B) is a palladium/tin colloid, the accelerator solution used is preferably an aqueous solution of an acid. The acid is selected, for example, from the group comprising sulphuric acid, hydrochloric acid, citric acid and tetrafluoroboric acid. In the case of a palladium/tin colloid, the accelerator solution helps to remove the tin compounds which served as the protective colloid.

Alternatively, in process step B i), a reductor treatment is performed when, in process step B), a solution of a metal compound has been used in place of a metal colloid for the activation. The reductor solution used for this purpose then comprises, if the solution of the metal compound was a hydrochloric acid solution of palladium chloride or an acidic solution of a silver salt, hydrochloric acid and tin(II) chloride.

The reductor solution may also comprise another reducing agent, such as $NaH_2PO_2$ or else a borane or borohydride, such as an alkali metal borane or alkaline earth metal borane or dimethylaminoborane. Preference is given to using $NaH_2PO_2$ in the reductor solution.

After the acceleration or treatment with the reductor solution in process step B i), the plastic surfaces can first be rinsed.

Process step B i) and optionally one or more rinse steps are followed by process step B ii) in which the plastic surfaces are metallized electrolessly. Electroless nickel-plating is accomplished, for example, using a conventional nickel bath which comprises, inter alia, nickel sulphate, a hypophosphite, for example sodium hypophosphite, as a reducing agent, and also organic complexing agents and pH adjusters (for example a buffer). The reducing agent used may likewise be dimethylaminoborane or a mixture of hypophosphite and dimethylaminoborane.

As an alternative to nickel-plating, electroless copper-plating of the plastic surface is possible. For copper-plating, it is possible to use an electroless copper bath typically comprising a copper salt, for example copper sulphate, copper chloride, copper-EDTA or copper hypophosphite, and also a reducing agent, such as formaldehyde or a hypophosphite salt, for example an alkali metal or ammonium salt, or hypophosphorous acid, and additionally one or more complexing agents such as tartaric acid, and also a pH adjuster such as sodium hydroxide.

The surface thus rendered conductive can subsequently be electrolytically further metallized in order to obtain a functional or decorative surface.

In a further embodiment of the invention, the plastic surfaces are metallized by means of direct electroplating, meaning that the plastic surfaces are metallized not electrolessly but directly by an electrolytic metallization process. In this embodiment, the following further process step is performed between process steps B) and C):

B i) treating the plastic surfaces in a conversion solution.

The embodiment is shown schematically in Table 3.

TABLE 3

Further embodiments of plastic metallization

| Process step | Constituents | Residence time | Temperature |
|---|---|---|---|
| A) Etching: A i) | 100 g/l sodium permanganate, 10 g/l sulphuric acid | 5-15 min | 70° C. |
| A ii) | 100 g/l $NaMnO_4$, 10 g/l NaOH | 10-25 min | 30-90° C. |
| A iii) Reduction | 100 g/l 96% sulphuric acid, 30 ml/l hydrogen peroxide, 30% by wt. | 1 min | 45° C. |
| A iv) Preliminary dipping | Hydrochloric acid, about 10% by wt. | 1 min | 20° C. |
| B) Activation | Palladium/tin colloid in hydrochloric acid solution, 50 mg/l-200 mg/l Pd | 3-6 min | 20-45° C. |
| B i) Conversion | Alkaline solution comprising copper ions | 1 min | >55° C. |
| C) Electrolytic metal deposition | For example electrochemical copper-plating or nickel-plating | 15-70 min | 20-35° C. |

The effect of the treatment of the plastic surfaces in a conversion solution is that an electrically conductive layer sufficient for a direct electrolytic metallization is formed on the plastic surfaces without prior electroless metallization. If the colloid in the colloid solution in process step B) is a palladium/tin colloid, the conversion solution used is preferably an alkaline solution of copper ions complexed by a complexing agent. For example, the conversion solution may comprise an organic complexing agent, such as tartaric acid, ethylenediaminetetraacetic acid (EDTA) or ethanolamine and/or a salt thereof, and a copper salt, such as copper sulphate.

After the treatment with the conversion solution in process step B i), the plastic surfaces can first be rinsed.

The plastic surface which has thus been rendered conductive can subsequently be further metallized electrolytically, in order to obtain a functional or decorative surface.

Step C) of the process according to the invention is the metallization of the plastic surface with a metallization solution. The metallization in process step C) can be effected electrolytically. For electrolytic metallization, it is possible to use any desired metal deposition baths, for example for deposition of nickel, copper, silver, gold, tin, zinc, iron, lead or alloys thereof. Such deposition baths are familiar to those skilled in the art. A Watts nickel bath is typically used as a bright nickel bath, this comprising nickel sulphate, nickel chloride and boric acid, and also saccharine as an additive. An example of a composition used as a bright copper bath is one comprising copper sulphate, sulphuric acid, sodium chloride and organic sulphur compounds in which the sulphur is in a low oxidation state, for example organic sulphides or disulphides, as additives.

The effect of the metallization of the plastic surface in process step C) is that the plastic surface is coated with metal, the metal being selected from the above-listed metals for the deposition baths.

In a further embodiment of the invention, after process step C), the following further process step is performed:

C i) storage of the metallized plastic surface at elevated temperature.

As in all electroplating processes in which a nonconductor is coated by wet-chemical means with a metal, the adhesion strength between metal and plastic substrate increases in the first period after the application of the metal layer. At room temperature, this process is complete after about three days. This can be accelerated considerably by storage at elevated temperature. The process is complete after about one hour at 80° C. It is assumed that the initially low adhesion strength is caused by a thin water layer which lies at the boundary between metal and nonconductive substrate and hinders the formation of electrostatic forces.

It has been found that the inventive etching with acidic and alkaline permanganate solution (process step A)) gives rise to a structure of the plastic surface which allows a greater contact area of the plastic with the metal layer than, for example, a conventional pretreatment with chromosulphuric acid. This is also the reason why higher adhesion strengths are achieved compared to the treatment with chromosulphuric acid (see Examples 2, 3 and 5). The smoother surface, however, sometimes gives even lower initial adhesion strength directly after the metallization than in the case of use of chromosulphuric acid. Especially in the case of nickel electroplating and very particularly when the metal layers deposited have high internal stresses, or when the coefficients of thermal expansion of metal and plastic are very different and the composite is exposed to rapidly alternating temperatures, the initial adhesion strength may not be sufficient.

In that case, the treatment of the metallized plastic surfaces at elevated temperature is advantageous. Such a step may involve treating a metallized article made of ABS plastic at elevated temperature in the range from 50° C. to 80° C. for a period between minutes and 60 minutes, preferably at a temperature of 70° C., in a water bath, in order that the water can be distributed at the metal-plastic interface in the plastic matrix. The effect of the treatment or storage of the metallized plastic surfaces at elevated temperature is that an initial, relatively low adhesion strength is enhanced further, such that, after process step C i), a adhesion strength of the metal layer applied to the plastic surface which is within the desired range of at least or greater than 0.6 N/mm is achieved.

The process according to the invention thus enables, with good process reliability and excellent adhesion strength of the subsequently applied metal layers, achievement of metallization of electrically nonconductive plastic surfaces of articles. In this context, not just planar plastic surfaces are metallized with high adhesion strength by the process according to the invention; instead, inhomogeneously shaped plastic surfaces are also provided with a homogeneous and strongly adhered metal coating.

Moreover, the inventive etching of the plastic surface with etching solutions comprising at least one acidic etching solution and at least one alkaline etching solution (process step A)) leads to much higher coverage of the plastic surfaces with a metal during the activation of the plastic surfaces with a solution of a colloid or of a compound of a metal.

WORKING EXAMPLES

The working examples described hereinafter are intended to illustrate the invention in detail.

Example 1

Inventive Example

A panel of Bayblend T45PG (10 cm×5 cm, ABS/PC mixture) was treated in a 40% solution of 2-(2-ethoxyethoxy) ethyl acetate which had been adjusted to pH=7 with a potassium phosphate buffer at 25° C. for 7 minutes (pretreatment step). Subsequently, the panel was rinsed under running water for about one minute.

The panel was treated in an acidic permanganate solution (100 g/l $NaMnO_4$, 10 g/l 96% $H_2SO_4$) which had been heated to 70° C. for 10 minutes. Thereafter, the panel was treated in an alkaline permanganate solution (30 g/l $NaMnO_4$ and 20 g/l NaOH) for 10 minutes (etching treatment I., process step A)).

Thereafter, the panel had a homogeneous brown surface. Reduction with a reduction solution composed of 25 ml/l 96% sulphuric acid and 30 ml/l 30% hydrogen peroxide at 40° C. removed the manganese dioxide from the panel (process step A iii)).

After subsequent rinsing and brief preliminary dipping into a solution of 300 ml/l 36% hydrochloric acid (process step A iv)), the panel was activated in a colloidal activator based on a palladium colloid (Adhemax Aktivator PL from Atotech, 125 mg/l palladium) at 40° C. for 5 minutes (process step B)).

Thereafter, the panel was rinsed and then immersed into a conversion solution based on copper ions (Futuron Ultra CuLink from Atotech, process step B i)) at 60° C. for one minute.

After rinsing, the panel was copper-plated by introducing it into a copper electroplating bath (Cupracid HT, from Atotech, process step C)) at room temperature and applying about 2.5 A of current.

The panel was completely and homogeneously copper-plated after 2 minutes.

The sequence of process steps in Example 1 is summarized in Table 4.

Example 2

Inventive Example

Two panels of Bayblend T45PG (10 cm×5 cm, ABS/PC mixture) were pretreated in a solution of 2-(2-ethoxyethoxy) ethyl acetate, as described in Example 1, and then rinsed under running water for about one minute.

The two panels were designated P1 and P2. Panel P1 was treated in an acidic permanganate solution (100 g/l $NaMnO_4$, 10 g/l 96% $H_2SO_4$) which had been heated to 70° C. for 10 minutes. Panel P2 was treated in the alkaline permanganate solution (30 g/l $NaMnO_4$ and 20 g/l NaOH) which had been kept at 50° C. for 10 minutes. Thereafter, panel P1 was treated in the alkaline permanganate solution described for 10 minutes (etching treatment I., process step A)) and panel P2 in the acidic permanganate solution described for 10 minutes (etching treatment II., process step A)).

Subsequently, the two panels, as described in Example 1, were treated with reduction solution and preliminarily dipped. Subsequently, the panels were activated in a colloid activator based on a palladium colloid (Adhemax Aktivator PL from Atotech, 23 ppm of palladium) at 40° C. for 5 minutes (process step B)).

Thereafter, the panels were rinsed and then the protective shells of the palladium particles were removed at 40° C. for 5 minutes (Adhemax ACC1 accelerator from Atotech, process step B i)). The panels were subsequently nickel-plated without external current for 10 minutes (Adhemax LFS, from Atotech, process step B ii)) at 45° C. While panel P1 thereafter had a homogeneous, matt, light grey nickel layer, there were some uncovered sites on which no nickel had been deposited on panel P2.

Thereafter, both panels were rinsed and copper-plated at 3.5 A/dm$^2$ at room temperature for one hour (Cupracid HT, from Atotech, process step C)). After rinsing, the panels were stored at 80° C. for one hour (process step C i)). Subsequently, the adhesion strength of the metal layers applied was determined by using a knife to cut out a strip of the metallized plastic panels of width 1 cm and measuring the precise width thereof. Subsequently, a tensile tester (from Instron) was used to pull the metal layer away from the plastic, and the force needed was registered (according to ASTM B 533 1985 Reapproved 2009). Panel P1 had a adhesion strength of the copper layer of 1.41 N/mm and 1.24 N/mm (mean: 1.32 N/mm), and panel P2 1.01 N/mm and 0.95 N/mm (mean: 0.98 N/mm).

The sequence of process steps in Example 2 is summarized in Table 5.

TABLE 4

| Sequence of process steps in Example 1 | | | |
|---|---|---|---|
| Process step | Chemistry | Time | Temperature |
| Pretreatment | 40% 2-(2-ethoxyethoxy) ethyl acetate in water, potassium phosphate buffer, pH = 7 | 7 min | 25° C. |
| A) Etching: | | | |
| Acidic etching | 100 g/l sodium permanganate, 10 g/l 96% sulphuric acid | 10 min | 70° C. |
| Alkaline etching | 30 g/l $NaMnO_4$ and 20 g/l NaOH | 10 min | 50° C. |
| A iii) Reduction | 25 ml/l 96% sulphuric acid, 30 ml/l hydrogen peroxide, 30% by wt. | 1 min | 40° C. |
| A iv) Preliminary dipping | 300 ml/l 36% hydrochloric acid | 1 min | 20° C. |
| B) Activation | Palladium colloid, 125 ppm of palladium | 5 min | 40° C. |
| B i) Conversion | Conversion solution based on copper ions, Futuron Ultra CuLink, from Atotech | 1 min | 60° C. |
| C) Electrolytic metal deposition | Electrochemical copper-plating, Cupracid HT, from Atotech, 2.5 A/$dm^2$ | 70 min | 21° C. |

TABLE 5

| Sequence of process steps in Example 2 | | | |
|---|---|---|---|
| Process step | Chemistry | Time | Temperature |
| Pretreatment | 40% 2-(2-ethoxyethoxy) ethyl acetate in water, potassium phosphate buffer, pH = 7 | 7 min | 25° C. |
| A) Etching: | | | |
| Acidic etching | 100 g/l sodium permanganate, 10 g/l 96% sulphuric acid | 10 min | 70° C. |
| Alkaline etching | 30 g/l $NaMnO_4$ and 20 g/l NaOH | 10 min | 50° C. |
| A iii) Reduction | 25 ml/l 96% sulphuric acid, 30 ml/l hydrogen peroxide, 30% by wt. | 1 min | 40° C. |
| A iv) Preliminary dipping | 300 ml/l 36% hydrochloric acid | 1 min | 20° C. |
| B) Activation | Palladium colloid, 23 ppm of palladium | 5 min | 40° C. |
| B i) Acceleration | Sulphuric acid 5% | 5 min | 40° C. |
| B ii) Electroless metal deposition | Chemically reductive nickel-plating, Adhemax LFS, from Atotech | 10 min | 40° C. |
| C) Electrolytic metal deposition | Electrochemical copper-plating, Cupracid HT, from Atotech, 3.5 A/$dm^2$ | 60 min | 21° C. |
| C i) Storage | — | 60 min | 80° C. |

Example 3

Comparative Experiment

Four panels of Bayblend T45 (5.2×14.9×0.3 cm, ABS/PC mixture) were pretreated in a solution of 2-(2-ethoxyethoxy) ethyl acetate for 10 minutes and rinsed as described in Example 1.

Etching treatment III.: Two of the pretreated panels were then treated with a warm (70° C.) acidic permanganate solution which comprised 100 g/l sodium permanganate and 10 g/l 96% sulphuric acid (final concentration: 0.1 mol/l sulphuric acid).

Etching treatment IV.: The two other pretreated panels were treated with alkaline permanganate solution which consisted of 30 g/l sodium permanganate and 20 g/l sodium hydroxide. The etching treatment was conducted at 70° C. for 10 minutes.

Etching treatment V.: Two further non-pretreated panels were treated with chromosulphuric acid solution which consisted of 380 g/l chromium(VI) oxide and 380 g/l 96% sulphuric acid. The etching treatment was conducted at 70° C. for 10 minutes.

Thereafter, all panels were rinsed under water for one minute and the panels from etching treatment III. and IV. were cleaned to free them of deposited manganese dioxide in a solution of 50 g/l 96% sulphuric acid and 30 ml/l 30% hydrogen peroxide (process step A iii)).

Subsequently, all panels were treated as specified in Example 2, namely rinsed, briefly preliminarily dipped (process step A iv)), activated in a palladium colloid (25 ppm of palladium) at 45° C. for three minutes (process step B)) and rinsed again, the protective shells of the palladium particles were removed at 50° C. (process step B i)), nickel-plating was effected without external current (process step B ii)), followed by rinsing, copper-plating for 70 minutes (process step C)) and storage at 80° C. for 30 minutes (process step C i)). Subsequently, the adhesion strength of the metal layer on the plastic panels was determined as described in Example 2.

For panels which had been etched by etching treatment III. (only acidic permanganate solution), adhesion strengths between 1.09 N/mm and 1.32 N/mm were found, for panels which had been etched by etching treatment IV. (only alkaline permanganate solution), adhesion strengths between 0 N/mm (bubbles between metal layer and plastic surface) and 0.25 N/mm were found, and, for panels which had been etched by etching treatment V. (chromosulphuric acid), adhesion strengths between 0.45 N/mm and 0.70 N/mm. In comparison, for panels which had been etched by the inventive etching treatment I. (first acidic permanganate solution, then alkaline permanganate solution), better adhesion strengths between 1.41 N/mm and 1.24 N/mm were found (see Example 2).

The sequence of process steps in Example 3 is summarized in Table 6.

TABLE 6

Sequence of process steps in Example 3

| Process step | Chemistry | Time | Temperature |
|---|---|---|---|
| Pretreatment | 40% 2-(2-ethoxyethoxy) ethyl acetate in water, potassium phosphate buffer, pH = 7, for etching treatments III. and IV. | 10 min | 20° C. |
| A) Etching | Various etching treatments | — | — |
| A iii) Reduction | 50 g/l 96% sulphuric acid, 30 ml/l hydrogen peroxide, 30% by wt., for etching treatments III. and IV. | 1 min | 45° C. |
| A iv) Preliminary dipping | 300 ml/l 36% hydrochloric acid | 1 min | 20° C. |
| B) Activation | Palladium colloid, 25 ppm of palladium | 3 min | 45° C. |
| B i) Acceleration | Sulphuric acid 5% | 5 min | 50° C. |
| B ii) Electroless metal deposition | Chemically reductive nickel-plating, Adhemax LFS, from Atotech | 10 min | 45° C. |
| C) Electrolytic metal deposition | Electrochemical copper-plating, Cupracid HT, from Atotech, 3.5 A/dm$^2$ | 70 min | 21° C. |
| C i) Storage | — | 30 min | 80° C. |

Example 4

Comparative Experiment

Two sets of panels of the plastics Novodur P2MC (ABS) and Bayblend T45 (ABS/PC mixture) of size 10.4 cm×14.9 cm×3 mm were treated for 10 minutes in a solution of 15% 2-(2-ethoxyethoxy) ethyl acetate and 10% butoxyethanol which had been adjusted to pH=7 with a potassium phosphate buffer and kept in a thermostat at 45° C.

Etching treatment III.: After careful rinsing, the panels were only acid-etched as described in Example 3 for 10 minutes.

Etching treatment I.: One of the two sets of panels was subsequently treated further in an alkaline permanganate solution which consisted of 30 g/l sodium permanganate and 20 g/l sodium hydroxide in a second etching step for 10 minutes at 50° C.

Etching treatment V.: A third set of panels made from plastics and having dimensions as described at the outset was treated in a chromosulphuric acid solution and then rinsed as described in Example 3.

The panels which had been treated by etching treatments I. and III. were then cleaned in a reduction solution of hydrogen peroxide and sulphuric acid and then rinsed as described in Example 2.

All panels from all etching treatments were subsequently preliminarily dipped into a solution of 300 ml/l 36% hydrochloric acid and treated with solutions of a colloidal activator of different palladium concentrations (Adhemax Aktivator PL from Atotech, for palladium concentrations see Table 7) at 40° C. for 5 minutes. In the course of this, the plates in the activator solution were not moved in order to obtain comparable values. The movement between a palladium solution and a plastic substrate has a great influence on the amount of surface-bound palladium achieved. Good movement would have led almost to doubling of the amounts of palladium taken up, but would have been difficult to reproduce. The panels were then rinsed and dried.

The dry panels were placed horizontally into a suitable crystallizing dish and covered with exactly 25 ml of aqua regia diluted 1:1 with water. After a reaction time of one minute, the liquid was collected from each panel and the palladium concentration therein was determined by ICP-OES.

The ICP-OES measurements were conducted with the Varian Vista MPX atomic emission spectrometer. For this purpose, the atomic emission spectrometer was calibrated with standard solutions of 0.10 mg/l; 0.25 mg/l; 0.50 mg/l; 2.0 mg/l and 5.0 mg/l palladium in 1% $HNO_3$. The samples were taken up in 1% $HNO_3$ and analysed directly. The instrument settings were as follows:

Wavelengths for palladium: 340.458 nm and 360.955 nm
Repetitions of the measurements: 3
Nebulizer gas pressure: 200 kPa
Auxiliary gas flow rate: 1.5 l/min
Plasma gas flow rate: 16.5 l/min
RF power of the high-frequency generator: 1250 watts The measurements were evaluated with the ICP Expert software accompanying the instruments and output directly as concentration values in mg/l. The palladium concentration found was then converted to the amount of palladium per unit area. The values obtained for the palladium bound to the plastic surfaces are summarized in Table 7 and shown in graph form in FIG. 1. The results are discussed in the description.

TABLE 7

Coverage of the surface of plastic panels with palladium after different etching treatments and activation with colloid of various palladium concentrations

| Etching | Panels | Pd concentration in the activator/ ppm | Pd coverage on surface of panels/ mg/m$^2$ |
|---|---|---|---|
| Etching treatment III.: Acidic permanganate | Novodur P2MC | 50 | 17.2 |
| | | 100 | 28.8 |
| | | 150 | 31.5 |
| | | 200 | 33.2 |
| | Bayblend T45 | 50 | 16.4 |
| | | 100 | 23.2 |

TABLE 7-continued

Coverage of the surface of plastic panels with palladium after different etching treatments and activation with colloid of various palladium concentrations

| Etching | Panels | Pd concentration in the activator/ ppm | Pd coverage on surface of panels/ mg/m$^2$ |
|---|---|---|---|
| | | 150 | 26.8 |
| | | 200 | 31.1 |
| Etching treatment I.: Acidic permanganate and alkaline permanganate | Novodur P2MC | 50 | 20.8 |
| | | 100 | 38.5 |
| | | 150 | 47.8 |
| | | 200 | 53.2 |
| | Bayblend T45 | 50 | 19.2 |
| | | 100 | 31.8 |
| | | 150 | 38.9 |
| | | 200 | 39.9 |
| Etching treatment V.: Chromosulphuric acid | Novodur P2MC | 50 | 26.0 |
| | | 100 | 29.1 |
| | | 150 | 35.2 |
| | | 200 | 39.4 |
| | Bayblend T45 | 50 | 13.4 |
| | | 100 | 20.0 |
| | | 150 | 22.8 |
| | | 200 | 31.0 |

Example 5

Comparative Experiment

Comparison of the adhesion strengths of metal layers on ABS/PC panels which have been applied by direct electroplating after various etching treatments.

Panels of Bayblend T45PG (5.2 cm×14.9 cm×0.3 cm; ABS/PC mixture) which were intended for etching treatments I., III. and IV. were treated in a solution of 2-(2-ethoxyethoxy) ethyl acetate (pretreatment step) and rinsed as described in Example 1.

Etching treatment III.: Four of the panels were then only acid-etched as described in Example 3 for 10 minutes.

Etching treatment I. (inventive etching treatment): Two of the panels which had already undergone etching treatment III. (acidic permanganate solution) were subsequently treated further with an alkaline permanganate solution as described in Example 4 for 2 minutes.

Etching treatment IV.: The last two panels which have been pretreated with glycol solution were treated with alkaline permanganate solution as described in Example 3 at 50° C.

Etching treatment V.: Two panels which had not been pretreated with glycol solution were etched with chromosulphuric acid solution as described in Example 3.

Thereafter, all panels were rinsed under water for one minute and the panels from etching treatments I., III. and IV. were cleaned in a reduction solution to remove deposited manganese dioxide (process step A iii)), as specified in Example 3.

Subsequently, all panels were treated as specified in Example 1, namely rinsed and briefly preliminarily dipped (process step A iv)) and activated in a palladium colloid (140 mg/l palladium) at 45° C. (process step B)), as described in Example 1.

To obtain an electrically conductive layer of the deposited palladium colloid, the panels were dipped into a conversion solution based on copper ions (Futuron Plus CuLink from Atotech, process step B i)) for 3 minutes.

After rinsing, all panels were copper-plated by introducing them into a copper electroplating bath (Cupracid HT, from Atotech, process step C)) at 25° C. for 70 minutes and applying 3 A/dm$^2$ of current.

After the plates had been stored at 70° C. for 60 minutes and cooled, the adhesion strengths of the copper layers on the plastic panels were determined as described in Example 2. Table 8.2 shows the resulting values for the adhesion strengths.

The sequence of process steps with the various etching treatments is summarized in Table 8.1. The rinse steps used after each process step are not listed.

TABLE 8.1

Direct electroplating of ABS/PC panels after various etching treatments.

| Process step | Residence time | Temperature |
|---|---|---|
| 40% by vol. of 2-(2-ethoxy-ethoxy)ethyl acetate | 7 min | 25° C. |
| One of the etching treatments: | | |
| I.: acidic permanganate solution and | 10 min | 70° C. |
| alkaline permanganate solution, or | 2 min | 50° C. |
| III.: acidic permanganate solution, or | 10 min | 70° C. |
| IV.: alkaline permanganate solution, or | 10 min | 50° C. |
| V.: 380 g/l $CrO_3$, 380 g/l 96% sulphuric acid* | 10 min | 70° C. |
| Removal of the manganese dioxide | 1 min | 40° C. |
| Activation | 5 min | 45° C. |
| Conversion (Futuron Plus CuLink) | 3 min | 60° C. |
| Copper plating (Cupracid HT, 3 A/dm$^2$) | 70 min | 25° C. |
| Storage | 60 min | 70° C. |

*If the etching treatment is performed in chromosulphuric acid, the pretreatment in 2-(2-ethoxyethoxy)ethyl acetate is omitted.

TABLE 8.2

Adhesion strengths of metal layers after direct electroplating of ABS/PC panels after various etching treatments

| Etching treatment | Etching solutions | Adhesion strength [N/mm] Individual measurements | Mean |
|---|---|---|---|
| I. | acidic and alkaline permanganate solution | 0.78/0.75/0.90/0.84 | 0.82 |
| III. | acidic permanganate solution | 0.72/0.74/0.70/0.82 | 0.75 |
| IV. | alkaline permanganate solution | 0.12/0.16/0.11/0.12 | 0.13 |
| V. | chromosulphuric acid | 0.52/0.53/0.55/0.59 | 0.55 |

The highest adhesion strengths were achieved for ABS/PC panels which had been treated with the combination of an acidic and subsequently alkaline permanganate etching step.

Example 6

Comparative Experiment

Comparison of Palladium Uptake by ABS/PC after Various Etching Treatments

This study was performed using panels of an ABS/PC mixture (Bayblend T45PG). The panels were 10 cm×7.5 cm×3 mm in size.

The panels were pretreated in a solution of 2-(2-ethoxyethoxy)ethyl acetate (pretreatment step) for 10 minutes and rinsed for about one minute, as described in Example 1.

Etching treatment I. (inventive etching treatment): Two panels, after the pretreatment, were treated first with a warm (70° C.) acidic permanganate solution which comprised 100 g/l sodium permanganate and 10 g/l 96% sulphuric acid (final concentration: 0.1 mol/l sulphuric acid) for 10 minutes.

Thereafter, the panels were treated with alkaline permanganate solution which consisted of 30 g/l sodium permanganate and 20 g/l sodium hydroxide at 50° C. for 2 minutes.

Etching treatment IV.: Two further pretreated panels were treated at 50° C. with alkaline permanganate solution as described in Example 3.

Thereafter, all panels were rinsed under water for one minute and treated at 45° C. in a reduction solution (process step A iii)), as specified in Example 3.

Subsequently, all panels were rinsed and briefly preliminarily dipped as described in Example 4. Subsequently, the panels were activated in a colloidal activator based on a palladium colloid (Adhemax Aktivator PL from Atotech, 140 mg/l palladium) at 45° C. for minutes (process step B)).

The procedure for determination of surface-bound palladium was as described in Example 4.

For etching treatment I. (first acidic permanganate solution, then alkaline permanganate solution), an amount of palladium of 42.5 mg/m$^2$ was found on the surfaces of the ABS/PC panels, and, for etching treatment IV. (only alkaline permanganate solution) 8.2 mg/m$^2$ of palladium.

The effect of the inventive etching treatment is that considerably more palladium is bound on plastic surfaces than when the surfaces have been treated only with an alkaline etching solution.

Example 7

Two panels each of the plastics Novodur P2 MC (ABS) and Bayblend T45 (ABS/PC mixture) of size 10 cm×7.5 cm×3 mm were treated in a solution of 2-(2-ethoxyethoxy)ethyl acetate as described in Example 1 for 10 minutes.

Etching treatment III.: After careful rinsing, all panels were treated in acidic permanganate solution as described in Example 3 for 10 minutes.

Etching treatment I.: One each of the ABS panels and of the ABS/PC panels which had been treated by etching treatment III. were subsequently treated further in an alkaline permanganate solution as described in Example 4.

Thereafter, all panels were dried and the manganese dioxide adhering on the surfaces of the panels was removed therefrom with the aid of 25 ml per panel of a solution of 50 g/l 96% sulphuric acid and 30 ml/l 30% hydrogen peroxide. In the resulting solutions, the manganese concentrations were determined by means of ICP-OES as described in Example 4 and converted to the area of the respective panel. The wavelengths for manganese used for the ICP-OES were: 257.610 nm and 259.372 nm. The values obtained for the manganese adhering on the plastic surfaces are summarized in Table 9.

TABLE 9

Amount of manganese on plastic surfaces after various etching treatments

| Panels | Etching treatment | Mn/g/m$^2$ |
|---|---|---|
| ABS | only acidic permanganate (III.) | 0.895 |
| | first acidic permanganate, then alkaline permanganate (I.) | 1.044 |
| ABS/PC | only acidic permanganate (III.) | 0.695 |
| | first acidic permanganate, then alkaline permanganate (I.) | 0.793 |

The amount of manganese found on the plastic surface is a measure of the amount of manganese dioxide bound during the etching. The combination of the etching of the plastic surfaces in an acidic permanganate solution and in an alkaline permanganate solution leads to a further increase in the amount of manganese dioxide deposited on the plastic surfaces compared to plastic surfaces which have been etched by a single acidic etching step (etching treatment III.).

Example 8

Influence of Residence Time in Solutions of Glycol Compounds on Adhesion Strengths, and Amounts of Manganese Dioxide and Palladium Deposited Panels of Bayblend T45PG (ABS/PC mixture) were treated in a 40% solution of 2-(2-ethoxyethoxy)ethyl acetate at 25° C. for various durations (for residence times see Table 10.2).

Etching treatment I.: Subsequently, the plates were etched in a first step with acidic permanganate solution and then with alkaline permanganate solution, as described in Example 6.

Deposited manganese dioxide was removed with a solution of 30 ml/l of 30% hydrogen peroxide in 5% sulphuric acid. For one set of panels with different residence times in the glycol solution, the amount of manganese deposited was determined by means of ICP-OES as described in Examples 4 and 7. The values obtained for the manganese adhering to the plastic surfaces are summarized in Table 10.2 and shown in FIG. 2. The amount of manganese found on the plastic surface is a measure for the amount of manganese dioxide bound during the etching.

After subsequent rinsing and brief dipping into a solution of 300 ml/l 36% hydrochloric acid (process step A iv)), the rest of the panels were activated in a colloidal activator based on a palladium colloid (Adhemax Aktivator PL from Atotech, 140 mg/l palladium) at 45° C. for 5 minutes (process step B)). For a further set of panels with different residence times in the glycol solution, the palladium bound to the plastic surfaces was removed again and the amount of palladium was determined by ICP-OES as described in Example 4. The values obtained are summarized in Table 10.2 and shown in graph form in FIG. 2.

Thereafter, the rest of the panels were rinsed and then dipped at 60° C. into a conversion solution (process step B i)), rinsed and then copper-plated as described in Example 5.

After storage at 70° C. for one hour, the adhesion strengths were determined in the peel test as described in Example 2. The adhesion strengths of the metal layer are summarized in Table 10.2 and shown in FIG. 2.

The sequence of process steps in Example 8 is summarized in Table 10.1.

TABLE 10.1

Sequence of process steps in Example 8

| Process step | Residence time | Temperature |
|---|---|---|
| 40% by vol. of 2-(2-ethoxyethoxy)ethyl acetate | 2 to 10 min | 25° C. |
| Acidic permanganate solution | 10 min | 70° C. |
| Alkaline permanganate solution | 2 min | 50° C. |
| Removal of the manganese dioxide | 1 min | 40° C. |
| Activation | 5 min | 45° C. |
| Conversion (Futuron Plus CuLink) | 3 min | 60° C. |
| Copper plating (Cupracid HT, 3 A/dm$^2$) | 70 min | 25° C. |
| Storage | 60 min | 70° C. |

TABLE 10.2

Adhesion strengths, amounts of Mn and Pd deposited as a function of the residence time of the plastic surfaces in the glycol solution for the pretreatment, *deposition of copper not possible

| Residence time [min] | Mn [mg/m$^2$] | Pd [mg/m$^2$] | Adhesion strength [N/mm] Individual values | Adhesion strength [N/mm] Mean values |
|---|---|---|---|---|
| 0 | 112.7 | 15.2 | —* | — |
| 2 | 268.0 | 29.9 | 0.48/0.60 | 0.54 |
| 4 | 347.2 | 37.5 | 0.77/0.87 | 0.82 |
| 6 | 366.3 | 42.8 | 0.95/1.03 | 0.99 |
| 8 | 417.3 | 49.1 | 1.00/1.10 | 1.05 |
| 10 | 423.4 | 43.3 | 0.93/0.91 | 0.92 |

The residence time of the plastic surfaces in the solution of the glycol compounds (pretreatment step) has an influence on the adhesion strength of the metal layers applied. Without treatment with glycol compounds (residence time 0 min in FIG. 2), it was not possible to deposit any metal by direct electroplating on the plastic surface. After a treatment with glycol compounds for only 4 minutes, in contrast, a good adhesion strength of 0.8 N/mm was already achieved, and this rises further with longer treatment time.

Example 9

Influence of Treatment Time and Temperature in Alkaline Permanganate Solution on Plastic Surfaces Panels of Bayblend T45PG (14.9 cm×5.1 cm×3 mm, surface area: 1.64 dm$^2$, ABS/PC mixture) were treated in a solution of 2-(2-ethoxyethoxy)ethyl acetate (pretreatment step) and rinsed as described in Example 1.

Etching treatment I.: The panels were first treated in an acidic permanganate solution (100 g/l $NaMnO_4$, 10 g/l 96% $H_2SO_4$) which had been heated to 70° C. for 10 minutes. Subsequently, the panels were introduced into an alkaline solution of 30 g/l sodium permanganate and 20 g/l sodium hydroxide which was employed in each case at 30° C., 50° C. and 70° C. for various durations (for residence times see Table 11).

By reduction with a reduction solution at 45° C., the manganese dioxide was removed from the panels within 30 seconds (process step A iii)), as described in Example 3.

Subsequently, all panels were treated as specified in Example 1, namely rinsed, briefly preliminarily dipped, activated in a palladium colloid (140 mg/l palladium) at 45° C., rinsed again, dipped into a conversion solution based on copper ions (Futuron Plus CuLink from Atotech, process step B i)) for 3 minutes, and copper-plated by applying 3.5 A/dm$^2$ of current in a copper electroplating bath for 70 minutes.

Between all process steps, the plastic substrates were rinsed under running water.

Subsequently, the copper-plated panels were stored at 70° C. for one hour and then the adhesion strength of the copper layer to the plastic substrate was determined with an Instron tensile tester as described in Example 2.

For each of these panels, a further panel was treated in parallel but removed from the process after the activation, and the amount of palladium bound on the surfaces was determined by ICP-OES as described in Example 4. Table 11 and FIGS. 3A and 3B show the results obtained for adhesion strength and amount of palladium. The results achieved are discussed in the description.

TABLE 11

Amount of palladium bound to the surfaces and adhesion strengths on plastic panels according to residence time of different length and temperature in the alkaline permanganate solution.

| Temperature [° C.] | Residence time [min] | Palladium [mg/m$^2$] | Adhesion strength [N/mm] Front/reverse side |
|---|---|---|---|
| 30 | 0 | 25.6 | 0.69/0.52 |
| | 1 | 33.5 | 0.86/0.65 |
| | 5 | 41.3 | 0.84/0.91 |
| | 10 | 38.7 | 0.80/0.73 |
| | 15 | 37.2 | 0.69/0.77 |
| 50 | 0 | 28.5 | 0.57/0.71 |
| | 1 | 42.8 | 0.83/0.85 |
| | 2 | 38.7 (41.2)* | 0.82/0.94 |
| | 5 | 41.3 | 0.72/0.72 |
| | 7 | 38.4 | 0.65/0.65 |
| | 10 | 39.8 (44.8) | 0.41/0.51 (0.56/0.59) |
| | 15 | 42.2 | 0.31/0.28 |
| 70 | 0 | 29.4 | 0.33/0.31 |
| | 2 | 37.0 | 0.65/0.70 |
| | 5 | 41.8 | 0.64/0.57 |
| | 10 | 44.8 | 0.45/0.46 |
| | 15 | 38.3 | 0.37/0.31 |

*Values in brackets are repeat measurements

Example 10

Comparative Example

Comparison of the Adhesion Strengths of Metal Layers after Various Etching Treatments Four panels of Bayblend T45PG (10 cm×5 cm, ABS/PC mixture) were pretreated in a solution of 2-(2-ethoxyethoxy) ethyl acetate, as described in Example 1, and then rinsed under running water for about one minute.

Etching treatment I: One pretreated panel was etched according to etching treatment I (first acidic permanganate etching solution, afterwards alkaline permanganate etching solution, inventive etching) as described in Example 2.

Etching treatment VI: A further pretreated panel was etched firstly with a solution of 10 g/l 96% $H_2SO_4$ containing no permanganate which had been heated to 70° C. for 10 minutes. Afterwards the panel was etched with the alkaline permanganate solution (30 g/l $NaMnO_4$ and 20 g/l NaOH) which had been kept at 50° C. for 10 minutes.

Etching treatment II: A further pretreated panel was etched according to etching treatment II (first alkaline permanganate etching solution, afterwards acidic permanganate etching solution, inventive etching) as described in Example 2.

Etching treatment VII: The last pretreated panel was etched firstly with the alkaline permanganate solution (30 g/l $NaMnO_4$ and 20 g/l NaOH) which had been kept at 50° C. for 10 minutes. Afterwards the panel was etched with a solution of 10 g/l 96% $H_2SO_4$ containing no permanganate which had been heated to 70° C. for 10 minutes.

Subsequently, the four panels, as described in Example 2, were treated with reduction solution and preliminarily dipped. Subsequently, the panels were activated in a colloid activator based on a palladium colloid (Adhemax Aktivator PL from Atotech, 50 ppm of palladium) at 35° C. for 5 minutes (process step B)).

Thereafter, the panels were rinsed and then the protective shells of the palladium particles were removed at 50° C. for 5 minutes (Adhemax ACC1 accelerator from Atotech, process step B i)). The panels were subsequently electrolessly nickel-plated, rinsed, electroplated with copper, rinsed again, stored at 80° C. and the adhesion strength of the deposited metal layers was determined as described in Example 2. Table 12 summarizes the results obtained for adhesion strength. The sequence of process steps in Example 10 is summarized in Table 13.

TABLE 12

Adhesion strengths of metal layers after various etching treatments

| Etching treatment | Etching solutions | Adhesion strength [N/mm] Individual measurements | Mean |
|---|---|---|---|
| I. | acidic permanganate and alkaline permanganate solution | 1.44/1.38/1.38 | 1.40 |
| VI. | acidic solution and alkaline permanganate solution | 0.10/0.12/0.11/0.11 | 0.11 |
| II. | alkaline permanganate and acidic permanganate solution | 0.58/0.62/0.71/1.16 | 0.77 |
| VII. | alkaline permanganate and acidic solution | 0.07/0.14/0.10/0.10 | 0.10 |

TABLE 13

Sequence of process steps in Example 10

| Process step | Chemistry | Time | Temperature |
|---|---|---|---|
| Pretreatment | 40% 2-(2-ethoxyethoxy) ethyl acetate in water, potassium phosphate buffer, pH = 7 | 7 min | 25° C. |
| A) Etching: | Various etching treatments | — | — |
| A iii) Reduction | 25 ml/l 96% sulphuric acid, 30 ml/l hydrogen peroxide, 30% by wt. | 1 min | 45° C. |
| A iv) Preliminary dipping | 300 ml/l 36% hydrochloric acid | 1 min | 20° C. |
| B) Activation | Palladium colloid, 50 ppm of palladium | 5 min | 35° C. |
| B i) Acceleration | Sulphuric acid 5% | 5 min | 50° C. |
| B ii) Electroless metal deposition | Chemically reductive nickel-plating, Adhemax LFS, from Atotech | 10 min | 40° C. |
| C) Electrolytic metal deposition | Electrochemical copper-plating, Cupracid HT, from Atotech, 3.5 A/dm$^2$ | 60 min | 21° C. |
| C i) Storage | — | 60 min | 80° C. |

The results show that for obtaining a high adhesion strength of metal layers deposited onto plastic substrates all of the etching solutions, the alkaline and the acidic etching solution, need to contain permanganate ions.

The invention claimed is:

1. Process for metallizing electrically nonconductive plastic surfaces of articles, comprising the process steps of:

A) treating the plastic surface with etching solutions to etch the plastic surface, wherein process step A) comprises the following steps, in any order:

treating the plastic surface with an acidic etching solution, and treating the plastic surface with an alkaline etching solution;

B) treating the etched plastic surface with a solution of a colloid or of a compound of a metal to activate the plastic surface; and C) metallizing the activated plastic surface with a metallizing solution;

wherein each of the etching solutions comprise a source for permanganate ions.

2. Process according to claim 1, wherein process step A) comprises the following steps in order:

A i) treating the plastic surface with the acidic etching solution, and

A ii) treating the plastic surface with the alkaline etching solution.

3. Process according to claim 2, wherein process step A) is preceded by performance of the following further process step:

pretreatment step: treating the plastic surface in an aqueous solution comprising at least one glycol compound.

4. Process according to claim 3, wherein the at least one glycol compound is selected from compounds of the general formula (I)

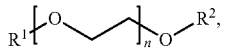

(I)

wherein n is an integer from 1 to 4; and $R^1$ and $R^2$ are each independently —H, —$CH_3$, —$CH_2$—$CH_3$, —$CH_2$—$CH_2$—$CH_3$, —$CH(CH_3)$—$CH_3$, —$CH_2$—$CH_2$—$CH_2$—$CH_3$, —$CH(CH_3)$—$CH_2$—$CH_3$, —$CH_2$—$CH(CH_3)$—$CH_3$, —$CH_2$—$CH_2$—$CH_2$—$CH_2$—$CH_3$, —$CH(CH_3)$—$CH_2$—$CH_2$—$CH_3$, —$CH_2$—$CH(CH_3)$—$CH_2$—$CH_3$, —$CH_2$—$CH_2$—$CH(CH_3)$—$CH_3$, —$CH(CH_2$—$CH_3)$—$CH_2$—$CH_3$, —$CH_2$—$CH(CH_2$—$CH_3)$—$CH_3$, —CO—$CH_3$, —CO—$CH_2$—$CH_3$, —CO—$CH_2$—$CH_2$—$CH_3$, —CO—$CH(CH_3)$—$CH_3$, —CO—$CH(CH_3)$—$CH_2$—$CH_3$, —CO—$CH_2$—$CH(CH_3)$—$CH_3$, —CO—$CH_2$—$CH_2$—$CH_2$—$CH_3$.

5. Process according to claim 2, wherein the following further process step is performed between process steps A) and B):

A iii) treating the plastic surface in a solution comprising a reducing agent for manganese dioxide.

6. Process according to claim 2, wherein the following further process step is performed between process steps B) and C):

B i) treating the plastic surfaces in a conversion solution.

7. Process according to claim 1, wherein process step A) is preceded by performance of the following further process step:

pretreatment step: treating the plastic surface in an aqueous solution comprising at least one glycol compound.

8. Process according to claim 7, wherein the at least one glycol compound is selected from compounds of the general formula (I)

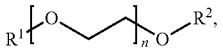

(I)

wherein n is an integer from 1 to 4; and $R^1$ and $R^2$ are each independently —H, —$CH_3$, —$CH_2$—$CH_3$, —$CH_2$—$CH_2$—$CH_3$, —$CH(CH_3)$—$CH_3$, —$CH_2$—$CH_2$—$CH_2$—$CH_3$, —$CH(CH_3)$—$CH_2$—$CH_3$, —$CH_2$—$CH(CH_3)$—$CH_3$, —$CH_2$—$CH_2$—$CH_2$—$CH_2$—$CH_3$, —$CH(CH_3)$—$CH_2$—$CH_2$—$CH_3$, —$CH_2$—$CH(CH_3)$—$CH_2$—$CH_3$, —$CH_2$—$CH_2$—$CH(CH_3)$—$CH_3$, —$CH(CH_2$—$CH_3)$—$CH_2$—$CH_3$, —$CH_2$—$CH(CH_2$—$CH_3)$—$CH_3$, —CO—$CH_3$, —CO—$CH_2$—$CH_3$, —CO—$CH_2$—$CH_2$—$CH_3$, —CO—$CH(CH_3)$—$CH_3$, —CO—$CH(CH_3)$—$CH_2$—$CH_3$, —CO—$CH_2$—$CH(CH_3)$—$CH_3$, —CO—$CH_2$—$CH_2$—$CH_2$—$CH_3$.

9. Process according to claim 7, wherein the following further process step is performed between process steps A) and B):

A iii) treating the plastic surface in a solution comprising a reducing agent for manganese dioxide.

10. Process according to claim 7, wherein the following further process step is performed between process steps B) and C):

B i) treating the plastic surfaces in a conversion solution.

11. Process according to claim 1, wherein the source for permanganate ions in the etching solutions in process step A) is selected independently from the group of alkali metal permanganates comprising potassium permanganate and sodium permanganate.

12. Process according to claim 11, wherein the source for permanganate ions in the etching solutions in process step A) is independently present in a concentration between 30 g/l and 250 g/l.

13. Process according to claim 1, wherein the acidic etching solution in process step A) further comprises an inorganic acid.

14. Process according to claim 13, wherein the inorganic acid is present in the acidic etching solution in process step A) in a concentration of 0.02-0.6 mol/l based on a monobasic acid.

15. Process according to claim 1, wherein the alkaline etching solution in process step A) further comprises a hydroxide ion source.

16. Process according to claim 15, wherein the hydroxide ion source is present in the alkaline etching solution in process step A) in a concentration between 1 g/l and 100 g/l.

17. Process according to claim 1, wherein the plastic surface has been manufactured from at least one electrically nonconductive plastic and the at least one electrically nonconductive plastic is selected from an acrylonitrile-butadiene-styrene copolymer, a polyamide, a polycarbonate and a mixture of an acrylonitrile-butadiene-styrene copolymer with at least one further polymer.

18. Process according to claim 1, wherein the following further process step is performed between process steps A) and B):

A iii) treating the plastic surface in a solution comprising a reducing agent for manganese dioxide.

19. Process according to claim 18, wherein the reducing agent for manganese dioxide is selected from hydroxylammonium sulphate, hydroxylammonium chloride and hydrogen peroxide.

20. Process according to claim 1, wherein the following further process step is performed between process steps B) and C):

B i) treating the plastic surfaces in a conversion solution to deposit metal ions on the activated plastic surface.

* * * * *